US009482035B2

(12) United States Patent
Wolf

(10) Patent No.: US 9,482,035 B2
(45) Date of Patent: Nov. 1, 2016

(54) RECESSED LOCK ACTUATING DEVICE FOR SLIDING DOORS

(71) Applicant: Glen M Wolf, Owatonna, MN (US)

(72) Inventor: Glen M Wolf, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

(21) Appl. No.: 14/744,623

(22) Filed: Jun. 19, 2015

(65) Prior Publication Data

US 2015/0368931 A1 Dec. 24, 2015

Related U.S. Application Data

(60) Provisional application No. 62/015,139, filed on Jun. 20, 2014.

(51) Int. Cl.
*E05F 1/00* (2006.01)
*E05B 65/08* (2006.01)

(52) U.S. Cl.
CPC ..... *E05B 65/08* (2013.01); *Y10T 70/625* (2015.04); *Y10T 292/0802* (2015.04); *Y10T 292/0825* (2015.04); *Y10T 292/0836* (2015.04)

(58) Field of Classification Search
CPC ..... E05B 65/087; E05B 29/00; E05B 27/00; E05C 1/08; Y10T 292/0836; Y10T 292/0802; Y10T 292/0825; Y10T 70/625
USPC ..... 49/449
See application file for complete search history.

(56) References Cited

U.S. PATENT DOCUMENTS

| | | | |
|---|---|---|---|
| 540,911 | A | 6/1895 | George |
| 912,378 | A | 2/1909 | Jackson |
| 932,330 | A | 8/1909 | Rotchford |
| 958,880 | A | 5/1910 | Lawson |
| 1,023,766 | A | 4/1912 | Sinclair |
| 1,051,918 | A | 2/1913 | Rowley |
| 1,065,172 | A | 6/1913 | Riggs |
| 1,070,366 | A | 8/1913 | Voight |
| 1,078,549 | A | 11/1913 | Northey |
| 1,174,652 | A | 3/1916 | Banks |
| 1,216,765 | A | 2/1917 | Anderson |
| 1,320,444 | A | 11/1919 | Buczynski et al. |
| 1,334,314 | A | 3/1920 | Parsons |
| 1,385,102 | A | 7/1921 | Winters et al. |
| 1,402,964 | A | 1/1922 | Robertson |
| 1,515,611 | A | 11/1924 | O'Connor |
| 1,533,243 | A | 4/1925 | Galterio |
| 1,559,160 | A | 10/1925 | Carter |
| 1,585,689 | A | 5/1926 | Piggot |
| 2,033,079 | A | 3/1936 | Lohrs |
| 2,066,705 | A | 1/1937 | Vazquez |

(Continued)

FOREIGN PATENT DOCUMENTS

| | | | |
|---|---|---|---|
| DE | 1095709 | B | 12/1960 |
| DE | 2914377 | A1 | 10/1980 |

(Continued)

*Primary Examiner* — Jerry Redman
(74) *Attorney, Agent, or Firm* — Patterson Thuente Pedersen, P.A.

(57) ABSTRACT

A low profile lock actuator assembly for locking, sliding doors, which can be provided in combination with a lock assembly or retrofitted to mate with an existing lock assembly. The lock actuator assembly includes an interior component and an exterior component, which are each coupled to an actuating assembly. The lock actuator assembly includes recessed or otherwise low profile handles.

16 Claims, 26 Drawing Sheets

(56) References Cited

U.S. PATENT DOCUMENTS

| | | | | | |
|---|---|---|---|---|---|
| D110,214 | S | | 6/1938 | Hazenberg | |
| 2,159,315 | A | | 5/1939 | Blue | |
| 2,166,535 | A | | 7/1939 | Särenholm et al. | |
| 2,406,459 | A | | 8/1946 | Gibson | |
| D152,198 | S | | 12/1948 | Hay | |
| 2,498,508 | A | | 2/1950 | Rudolph | |
| 2,701,156 | A | | 2/1955 | Palmer, Jr. | |
| 2,701,157 | A | | 2/1955 | Le Bon, III | |
| 2,712,464 | A | | 7/1955 | Collar et al. | |
| 2,736,185 | A | | 2/1956 | Collar | |
| 2,789,851 | A | | 4/1957 | Eads | |
| 2,823,941 | A | | 2/1958 | Ellis | |
| 2,855,234 | A | | 10/1958 | Eads | |
| 2,924,475 | A | | 2/1960 | Russell | |
| D188,040 | S | | 5/1960 | Henshaw | |
| 2,943,514 | A | | 7/1960 | Golde | |
| 2,980,458 | A | | 4/1961 | Russell | |
| 3,041,097 | A | | 6/1962 | Eads | |
| 3,088,471 | A | | 5/1963 | Fiore | |
| 3,105,711 | A | | 10/1963 | Woodworth et al. | |
| 3,120,748 | A | * | 2/1964 | Rechberg | 70/100 |
| 3,151,350 | A | | 10/1964 | Manion | |
| 3,216,229 | A | * | 11/1965 | Moncada | 70/100 |
| 3,304,658 | A | | 2/1967 | Kreger | |
| 3,342,516 | A | | 9/1967 | Morand | |
| 3,381,990 | A | | 5/1968 | Kreger | |
| 3,390,557 | A | * | 7/1968 | Erickson et al. | 70/97 |
| 3,400,562 | A | | 9/1968 | Bloss | |
| 3,543,441 | A | | 12/1970 | La Porte | |
| 3,586,360 | A | | 6/1971 | Perrotta | |
| 3,596,954 | A | | 8/1971 | Hull et al. | |
| 3,638,461 | A | | 2/1972 | Watson | |
| 3,666,306 | A | | 5/1972 | Genakis | |
| 3,949,525 | A | | 4/1976 | Bates et al. | |
| 3,953,061 | A | | 4/1976 | Hansen et al. | |
| 3,958,822 | A | | 5/1976 | Germer | |
| 4,050,272 | A | | 9/1977 | Tanaka | |
| D246,421 | S | | 11/1977 | Ridgway et al. | |
| 4,068,874 | A | | 1/1978 | Fleming et al. | |
| 4,118,056 | A | | 10/1978 | Alexander | |
| 4,148,106 | A | | 4/1979 | Gallien | |
| D252,012 | S | | 6/1979 | Pittenger | |
| 4,199,060 | A | | 4/1980 | Howard | |
| 4,253,688 | A | | 3/1981 | Hosooka | |
| 4,335,816 | A | | 6/1982 | Rager | |
| 4,341,407 | A | | 7/1982 | Zankich | |
| D268,321 | S | | 3/1983 | Tegner | |
| 4,389,061 | A | | 6/1983 | Foshee | |
| D270,994 | S | | 10/1983 | Tegner | |
| D272,714 | S | | 2/1984 | LeGrand | |
| 4,434,635 | A | | 3/1984 | Borgato | |
| D274,123 | S | | 6/1984 | Tegner | |
| 4,476,700 | A | | 10/1984 | King | |
| 4,480,862 | A | | 11/1984 | Fleming | |
| 4,547,006 | A | | 10/1985 | Castanier | |
| 4,602,457 | A | | 7/1986 | Kreusel | |
| 4,639,021 | A | | 1/1987 | Hope | |
| 4,643,005 | A | | 2/1987 | Logas | |
| 4,676,537 | A | | 6/1987 | Esser | |
| 4,739,583 | A | | 4/1988 | Tönsmann et al. | |
| 4,754,624 | A | | 7/1988 | Fleming et al. | |
| D297,505 | S | | 9/1988 | Mosch | |
| 4,790,157 | A | * | 12/1988 | Lin | 70/95 |
| 4,803,808 | A | | 2/1989 | Greisner | |
| 4,877,274 | A | | 10/1989 | Poe | |
| 4,932,691 | A | | 6/1990 | White | |
| 4,958,508 | A | | 9/1990 | Lin | |
| 4,962,653 | A | | 10/1990 | Kaup | |
| 4,973,091 | A | | 11/1990 | Paulson et al. | |
| D312,565 | S | | 12/1990 | Abraham et al. | |
| 4,980,946 | A | | 1/1991 | Verasani et al. | |
| 4,988,133 | A | | 1/1991 | Shih | |
| 4,991,886 | A | | 2/1991 | Nolte et al. | |
| D316,805 | S | | 5/1991 | Paulson et al. | |
| D316,806 | S | | 5/1991 | Paulson et al. | |
| D316,807 | S | | 5/1991 | Paulson et al. | |
| D319,772 | S | | 9/1991 | Mosch | |
| 5,045,265 | A | | 9/1991 | Pettit | |
| D320,334 | S | | 10/1991 | Clancy | |
| 5,058,938 | A | | 10/1991 | Döring et al. | |
| 5,078,200 | A | | 1/1992 | Guntermann et al. | |
| 5,087,087 | A | | 2/1992 | Vetter et al. | |
| 5,092,144 | A | * | 3/1992 | Fleming et al. | 70/95 |
| D326,990 | S | | 6/1992 | Bishop | |
| 5,118,145 | A | | 6/1992 | Tucker | |
| 5,120,094 | A | | 6/1992 | Eaton et al. | |
| D329,369 | S | | 9/1992 | Martin et al. | |
| D330,839 | S | | 11/1992 | Barrington et al. | |
| 5,170,533 | A | | 12/1992 | Barry | |
| 5,183,310 | A | | 2/1993 | Shaughnessy | |
| 5,197,771 | A | | 3/1993 | Kaup et al. | |
| 5,210,905 | A | | 5/1993 | Dietz et al. | |
| 5,245,846 | A | | 9/1993 | James | |
| D340,398 | S | | 10/1993 | Clancy | |
| 5,253,903 | A | | 10/1993 | Daley | |
| 5,290,077 | A | | 3/1994 | Fleming | |
| 5,301,525 | A | | 4/1994 | Döring | |
| 5,318,333 | A | | 6/1994 | Dreifert | |
| 5,370,428 | A | | 12/1994 | Dreifert et al. | |
| 5,373,716 | A | | 12/1994 | MacNeil et al. | |
| 5,388,875 | A | | 2/1995 | Fleming | |
| 5,495,731 | A | | 3/1996 | Riznik | |
| 5,498,038 | A | | 3/1996 | Simon et al. | |
| 5,524,941 | A | | 6/1996 | Fleming | |
| 5,524,942 | A | | 6/1996 | Fleming | |
| 5,531,492 | A | | 7/1996 | Raskevicius | |
| 5,542,720 | A | | 8/1996 | Fleming | |
| 5,595,409 | A | | 1/1997 | Fier et al. | |
| 5,603,538 | A | | 2/1997 | Evers | |
| 5,620,216 | A | | 4/1997 | Fuller | |
| 5,642,909 | A | | 7/1997 | Swan et al. | |
| 5,660,420 | A | | 8/1997 | Smith et al. | |
| D384,266 | S | | 9/1997 | Mantarakis et al. | |
| D384,568 | S | | 10/1997 | Mantarakis et al. | |
| D389,722 | S | | 1/1998 | Blom | |
| 5,722,704 | A | | 3/1998 | Chaput et al. | |
| 5,741,031 | A | | 4/1998 | Bauman et al. | |
| 5,752,727 | A | | 5/1998 | Zues et al. | |
| 5,778,602 | A | | 7/1998 | Johnson et al. | |
| 5,782,114 | A | | 7/1998 | Zeus et al. | |
| 5,791,790 | A | | 8/1998 | Bender et al. | |
| D397,604 | S | | 9/1998 | Libby et al. | |
| 5,813,255 | A | | 9/1998 | Tell, III et al. | |
| 5,820,170 | A | | 10/1998 | Clancy | |
| 5,820,177 | A | | 10/1998 | Moon | |
| 5,839,767 | A | | 11/1998 | Piltingsrud | |
| 5,878,605 | A | | 3/1999 | Renz | |
| 5,878,606 | A | | 3/1999 | Chaput et al. | |
| 5,896,763 | A | | 4/1999 | Dinkelborg et al. | |
| 5,901,989 | A | | 5/1999 | Becken et al. | |
| 5,906,403 | A | | 5/1999 | Bestler et al. | |
| 5,927,767 | A | | 7/1999 | Smith et al. | |
| 5,951,068 | A | | 9/1999 | Strong et al. | |
| 6,006,560 | A | | 12/1999 | DeVries | |
| 6,045,169 | A | | 4/2000 | Frolov | |
| D427,878 | S | | 7/2000 | Frey | |
| 6,135,511 | A | | 10/2000 | Smith et al. | |
| D433,916 | S | | 11/2000 | Frey | |
| 6,152,498 | A | | 11/2000 | Lindqvist | |
| 6,161,881 | A | | 12/2000 | Babka et al. | |
| 6,209,931 | B1 | | 4/2001 | Von Stoutenborough et al. | |
| 6,217,087 | B1 | | 4/2001 | Fuller | |
| 6,264,252 | B1 | | 7/2001 | Clancy | |
| 6,266,981 | B1 | | 7/2001 | von Resch et al. | |
| 6,282,929 | B1 | | 9/2001 | Eller et al. | |
| 6,324,876 | B1 | | 12/2001 | Prevot et al. | |
| 6,327,881 | B1 | | 12/2001 | Gründler et al. | |
| 6,349,982 | B2 | | 2/2002 | Fayngersh et al. | |
| 6,354,121 | B1 | | 3/2002 | Frolov | |
| 6,367,853 | B1 | | 4/2002 | Briggs | |
| 6,389,855 | B2 | | 5/2002 | Renz et al. | |
| 6,393,878 | B1 | | 5/2002 | Fayngersh et al. | |
| D467,784 | S | | 12/2002 | Maier | |
| 6,557,909 | B2 | | 5/2003 | Morris | |

(56) References Cited

U.S. PATENT DOCUMENTS

| | | | | |
|---|---|---|---|---|
| D482,592 | S | 11/2003 | Thuma | |
| 6,651,389 | B2 | 11/2003 | Minter et al. | |
| 6,651,466 | B1 | 11/2003 | Shih | |
| 6,672,632 | B1 | 1/2004 | Speed et al. | |
| 6,682,109 | B2 | 1/2004 | Horne et al. | |
| 6,688,656 | B1 | 2/2004 | Becken | |
| 6,776,441 | B2 | 8/2004 | Liu | |
| 6,837,004 | B2 | 1/2005 | Annes | |
| 6,871,451 | B2 | 3/2005 | Harger et al. | |
| 6,871,884 | B2 | 3/2005 | Hoffmann et al. | |
| 6,945,572 | B1 | 9/2005 | Hauber | |
| D511,670 | S | 11/2005 | Chen | |
| 6,962,377 | B2 | 11/2005 | Tönges | |
| 6,971,686 | B2 | 12/2005 | Becken | |
| 6,981,724 | B2 | 1/2006 | Denys | |
| 7,003,990 | B2 | 2/2006 | Iliuk | |
| 7,004,515 | B2 | 2/2006 | Timothy | |
| 7,025,394 | B1 | 4/2006 | Hunt | |
| 7,040,671 | B2 | 5/2006 | Liu | |
| D523,725 | S | 6/2006 | Chen | |
| 7,108,300 | B2 | 9/2006 | Hodgin et al. | |
| D531,482 | S | 11/2006 | Chen | |
| 7,178,839 | B2 | 2/2007 | Tsai | |
| 7,261,330 | B1 | 8/2007 | Hauber | |
| 7,303,215 | B2 | 12/2007 | Moon et al. | |
| 7,373,794 | B1 * | 5/2008 | DePass | 70/99 |
| 7,510,222 | B2 | 3/2009 | Hodgin et al. | |
| 7,604,265 | B2 | 10/2009 | Tsai | |
| 7,752,875 | B2 | 7/2010 | Constantinou et al. | |
| 8,398,126 | B2 | 3/2013 | Nakanishi et al. | |
| 2004/0145189 | A1 | 7/2004 | Liu | |
| 2006/0071478 | A1 | 4/2006 | Denys | |
| 2006/0076783 | A1 | 4/2006 | Tsai | |
| 2006/0087125 | A1 | 4/2006 | Moon et al. | |
| 2006/0091679 | A1 | 5/2006 | Tsai | |
| 2006/0119108 | A1 | 6/2006 | Heid et al. | |
| 2007/0096476 | A1 | 5/2007 | Vetter | |
| 2009/0241611 | A1 * | 10/2009 | Brisco et al. | 70/95 |

FOREIGN PATENT DOCUMENTS

| | | | |
|---|---|---|---|
| DE | 10255733 | A1 | 6/2004 |
| EP | 0117744 | A2 | 9/1984 |
| EP | 0431369 | A2 | 6/1991 |
| EP | 0327264 | B1 | 12/1992 |
| EP | 0943767 | B1 | 3/1999 |
| FR | 2435586 | A1 | 4/1980 |
| GB | 1396876 | A * | 6/1975 |
| GB | 2196375 | A | 4/1988 |
| GB | 2212849 | A | 8/1989 |
| GB | 2281097 | A | 2/1995 |
| GB | 2337556 | A | 11/1999 |
| JP | H0610553 | A | 1/1994 |

* cited by examiner

RECESSED LOCK ACTUATING DEVICE FOR SLIDING DOORS

RELATED APPLICATIONS

This application claims priority to U.S. Provisional Application No. 62/015,139, filed Jun. 20, 2014, said Application being hereby incorporated herein by reference in its entirety.

FIELD OF THE INVENTION

The present invention relates generally to door locks, and more particularly relates to a low profile lock actuating device for use with sliding doors.

BACKGROUND OF THE INVENTION

Sliding doors, such as patio doors, commonly utilize locking devices on the door locking-side stile which engage into keepers mounted on the side jamb frame to provide environmental control and security and to prevent unintentional opening of the doors. Projecting handles and interior thumb-turns and exterior key cylinders are commonly used devices to actuate the locks to the locked and unlocked condition and are also used as a hand-grip to be able to slide the door open or closed. There is often a need for sliding patio doors to have low or recessed profile lock actuators and hand-grips whenever separate door panels need to slide freely by other sliding or stationary panels, or into a wall side pocket, to avoid hitting opposing door panels or wall openings with the lock actuators and hand-grips to prevent prematurely stopping or damage of both the hardware and door panels. Low profile lock actuator and hand-grip devices are also desirable to prevent catching on draperies or other door treatments when opened, while also being aesthetically pleasing.

A number of flush mount lock actuation and hand-grip devices with either low profile or recessed features are currently on the market which address this need, but such products are limited to interfacing with just a few mating lock styles, and/or are difficult to assemble to the mating lock. What is needed is a low profile lock actuator and hand-grip system that interfaces with a wide variety of single point and multi-point locks in the industry and which is also easy to assemble and operate.

SUMMARY OF THE INVENTION

In various embodiments, the present invention comprises a lock actuating assembly which is easy to assemble and operate, and is capable of interfacing with a wide variety of lock styles including single point and multi-point locks.

In an embodiment, a lock assembly includes an interior lock actuator assembly with an interior escutcheon presenting a planar outer surface and including a first handle portion recessed relative to the outer surface and a first control, a first rotatable drive disk, a second rotatable drive disk, and a slide arm operably coupled with the first drive disk, the second drive disk, and the first control. The lock assembly further an exterior lock actuator assembly with an exterior escutcheon presenting a planar outer surface and including a second handle portion recessed relative to the outer surface and a second control, the second control operably coupled with the second drive disk, and a lock assembly. The lock assembly includes a housing and at least one lock element, the at least one lock element selectively shiftable between an unlocked position in which the at least one lock element is contained in the housing and a locked position in which the at least one lock element extends from the housing, wherein the first drive disk is operably connected with the at least one lock element so as to drive shifting of the at least one lock element between the unlocked position and the locked position when the first drive disk is rotated, and wherein the first control and the second control are selectively operable to rotate the first drive disk.

In embodiments, the first control can be a thumb slide. The thumb slide may be coupled to the slide arm so as to vertically shift the slide arm, and the slide arm coupled to the first drive disk such that vertical shifting of the slide arm rotates the first drive disk.

In embodiments, the second control can be a key cylinder. The key cylinder may be operably coupled to the second drive disk. In embodiments, the at least one lock element may be a hook.

In other embodiments, a sliding door assembly includes a door panel slidably mounted in a frame, the frame including a jamb, and a lock assembly in the door panel. The lock assembly includes an interior lock actuator assembly with an interior escutcheon presenting a planar outer surface and including a first handle portion recessed relative to the outer surface and a first control, a first rotatable drive disk, a second rotatable drive disk, and a slide arm operably coupled with the first drive disk, the second drive disk, and the first control. The assembly further includes an exterior lock actuator assembly with an exterior escutcheon presenting a planar outer surface and including a second handle portion recessed relative to the outer surface and a second control, the second control operably coupled with the second drive disk, and a lock assembly. The lock assembly includes a housing and at least one lock element, the at least one lock element selectively shiftable between an unlocked position in which the at least one lock element is contained in the housing and a locked position in which the at least one lock element extends from the housing to engage a keeper in the jamb, wherein the first drive disk is operably connected with the at least one lock element so as to drive shifting of the at least one lock element between the unlocked position and the locked position when the first drive disk is rotated, and wherein the first control and the second control are selectively operable to rotate the first drive disk.

In embodiments the first control may be a thumb slide. The thumb slide may be coupled to the slide arm so as to vertically shift the slide arm, and the slide arm coupled to the first drive disk such that vertical shifting of the slide arm rotates the first drive disk.

In embodiments of the invention the second control may be a key cylinder. The key cylinder may be operably coupled to the second drive disk. In embodiments, the at least one lock element may be a hook.

In embodiments, a lock actuator assembly includes an interior lock actuator assembly with an interior escutcheon presenting a planar outer surface and including a first handle portion recessed relative to the outer surface and a control, at least one rotatable drive disk, and a vertically slidable arm operably coupled with the at least one drive disk so as to rotate the at least one drive disk when the arm is shifted vertically with the control. The assembly further has an exterior lock actuator assembly with an exterior escutcheon presenting a planar outer surface and including a second handle portion recessed relative to the outer surface. The at least one rotatable drive disk is adapted to couple with a lock assembly so as to shift the lock assembly between a locked position and an unlocked position when the at least one rotatable drive disk rotates.

In embodiments, the control may be a thumb slide. The assembly can further include a second rotatable drive disk operably coupled to the arm such that rotation of the second drive disk vertically shifts the arm. The exterior lock actuator assembly can include a second control rotatably coupled to the second drive disk. The second control may be a key cylinder.

BRIEF DESCRIPTION OF THE DRAWINGS

The invention may be more completely understood in consideration of the following detailed description of various embodiments of the invention in connection with the accompanying drawings, in which.

Figure 1:
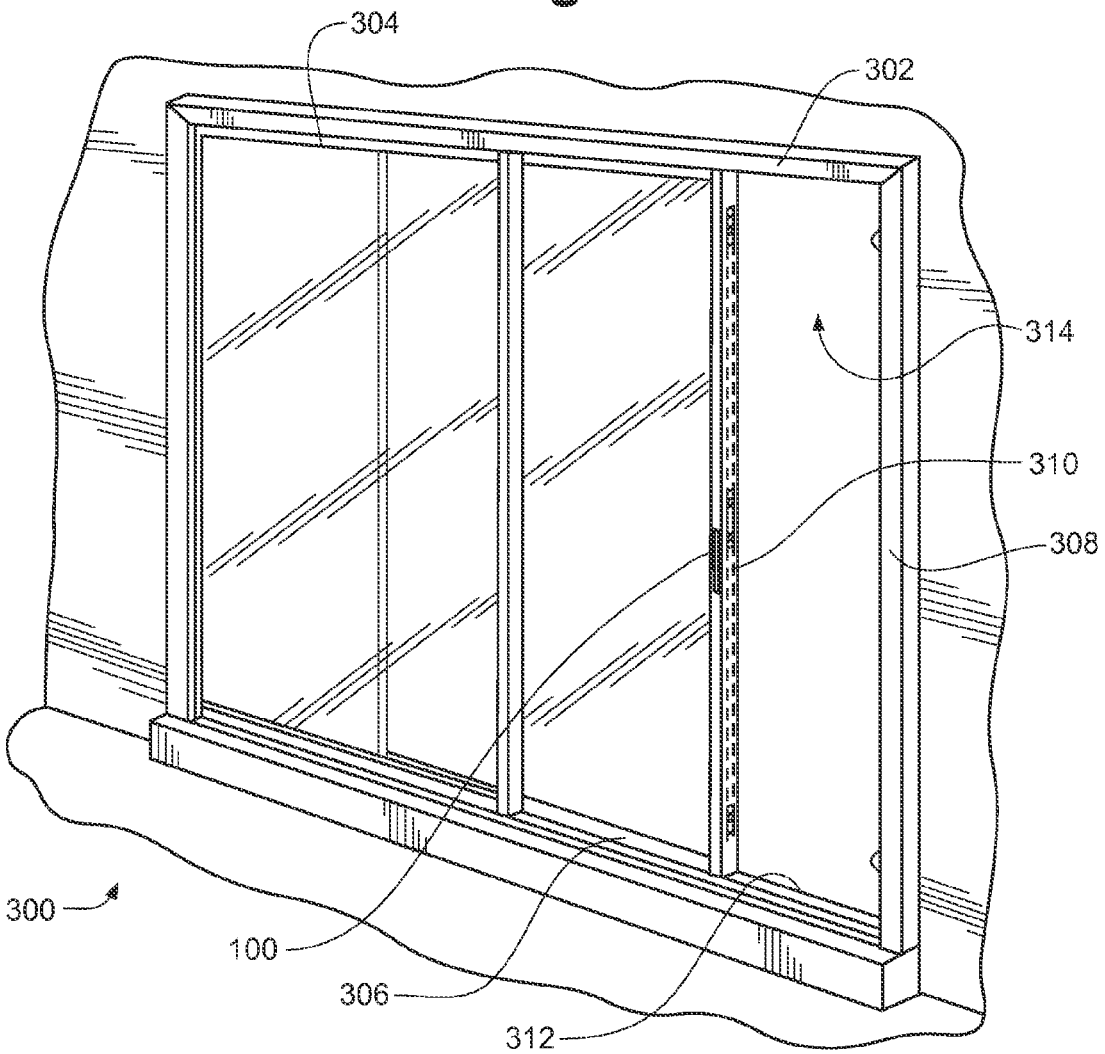
FIG. 1 is an isometric view of a sliding door assembly according to an embodiment of the invention.
Figure 1A:
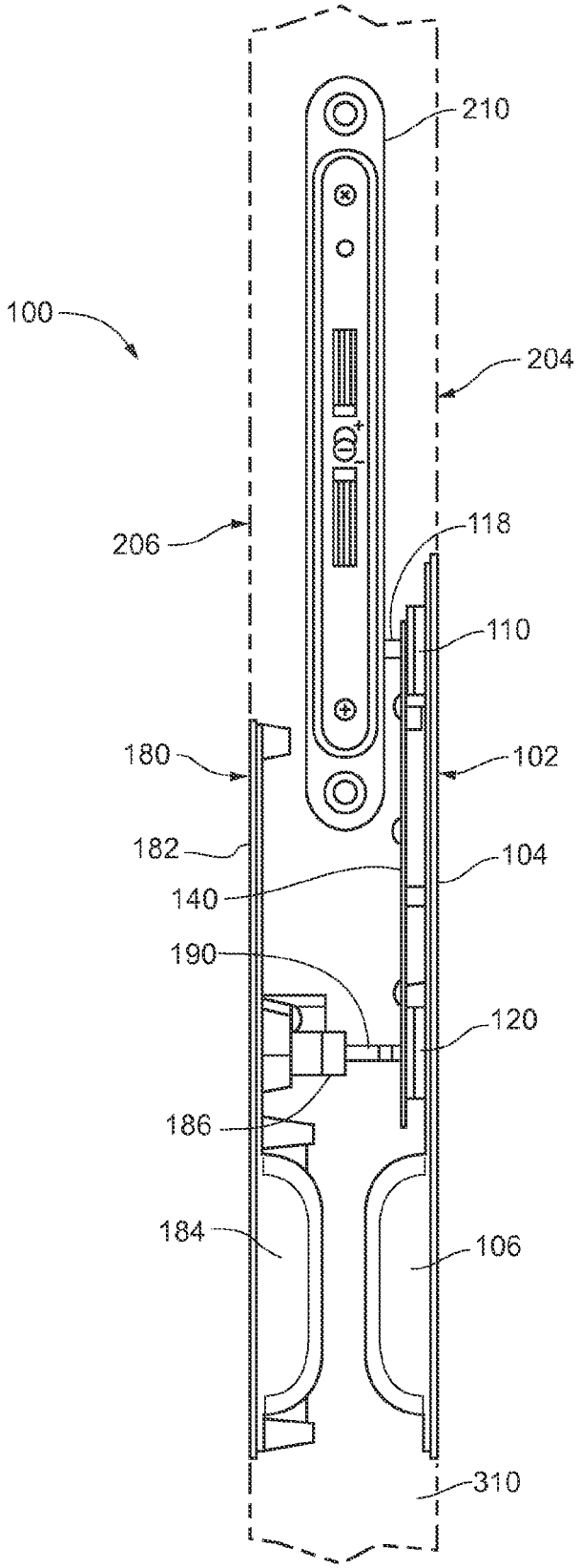
FIG. 1A is an end elevation view of a lock actuating assembly according to an embodiment of the invention, with a door stile depicted in phantom.

While the invention is amendable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE DRAWINGS

The following detailed description should be read with reference to the drawings in which similar elements in different drawings are numbered the same. The drawings, which are not necessarily to scale, depict illustrative embodiments and are not intended to limit the scope of the invention.

Referring to FIG. 1, a sliding door assembly 300 generally includes frame 302, fixed door panel 304, and sliding door panel 306. Frame 302 generally includes jamb 308. Sliding door panel 306 generally includes side stile 310, and is laterally slidable in tracks 312 to open and close opening 314 defined by frame 302.

Figure 1B:
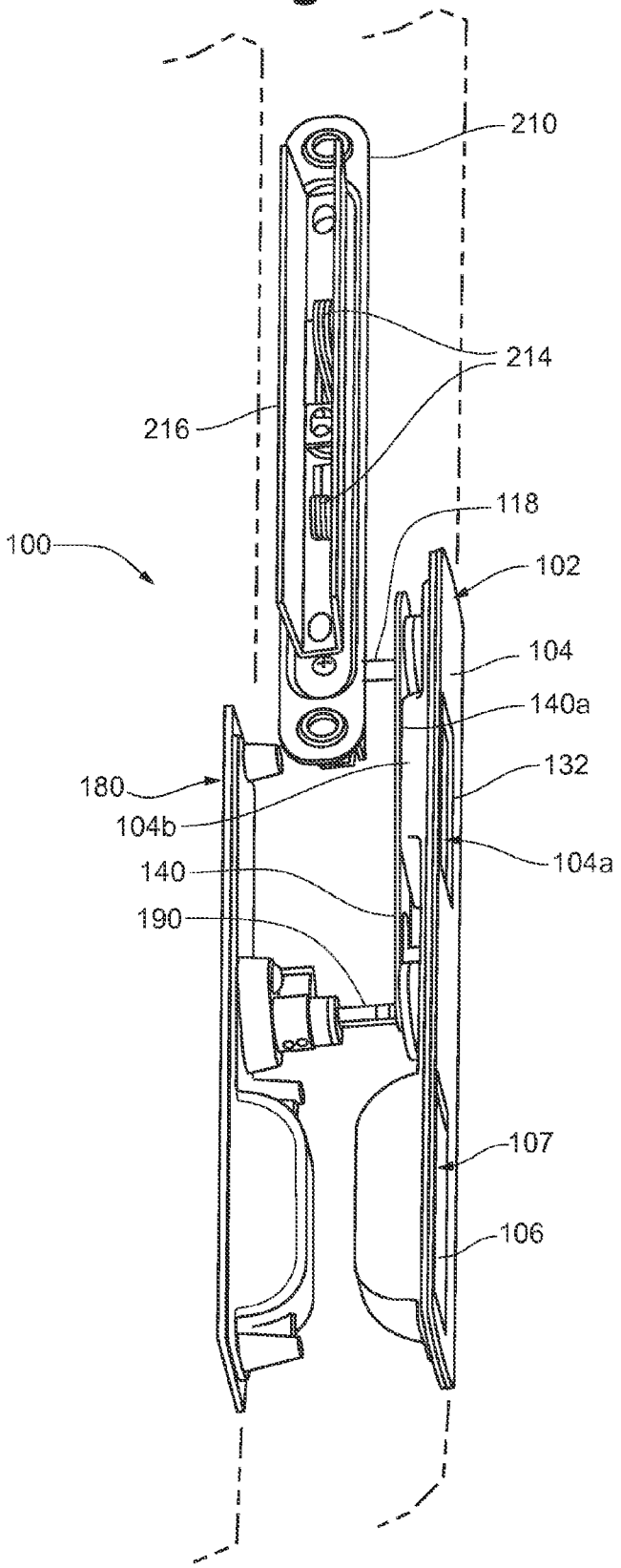
FIG. 1B is an orthogonal view of the lock actuating assembly of FIG. 1A, with a door assembly depicted in phantom.
Figure 1C:
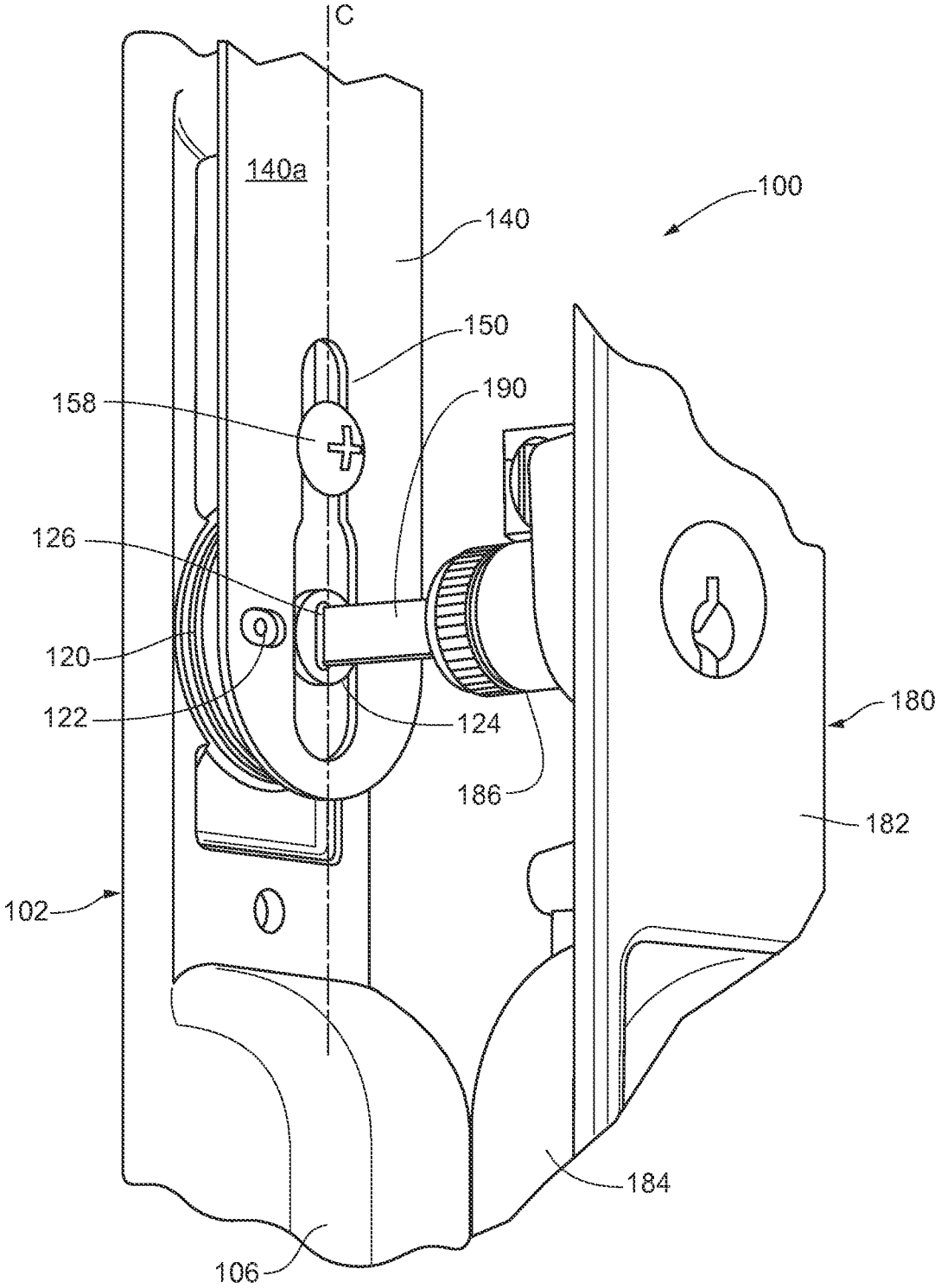
FIG. 1C is a close-up orthogonal view of a portion of the lock actuating assembly of FIG. 1A.
Figure 1D:
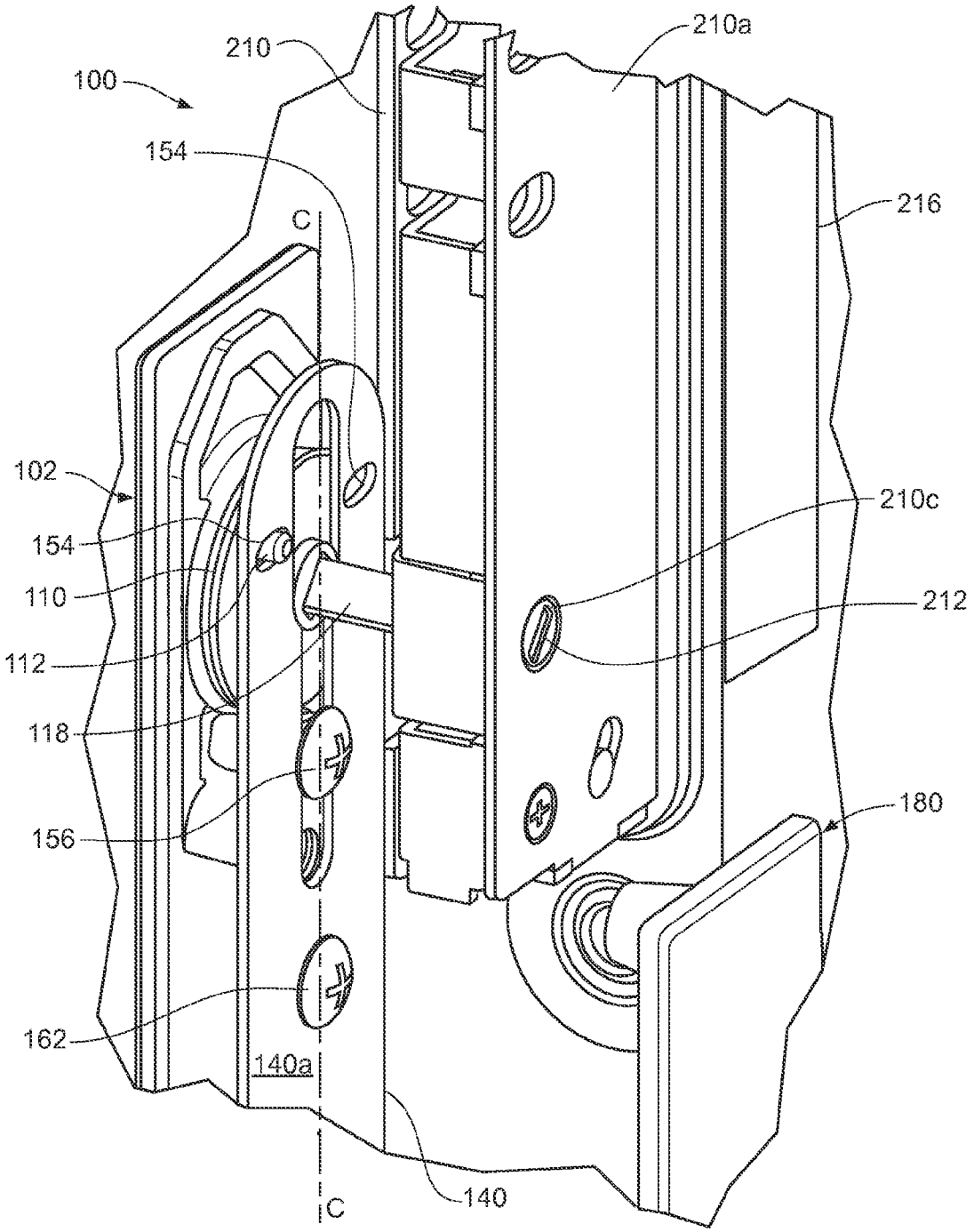
FIG. 1D is a close-up orthogonal view of another portion of the lock actuating assembly of FIG. 1A.

Referring to FIGS. 1-1D, a lock actuating assembly 100 is depicted which generally includes an interior lock actuator assembly 102 and an exterior lock actuator assembly 180. In an embodiment, lock assembly 210 may be included as part of lock actuating assembly 100. In other embodiments, lock actuating assembly 100 and lock assembly 210 are separate components, with lock actuating assembly 100 configured to couple with lock assembly 210.

Figure 2A:
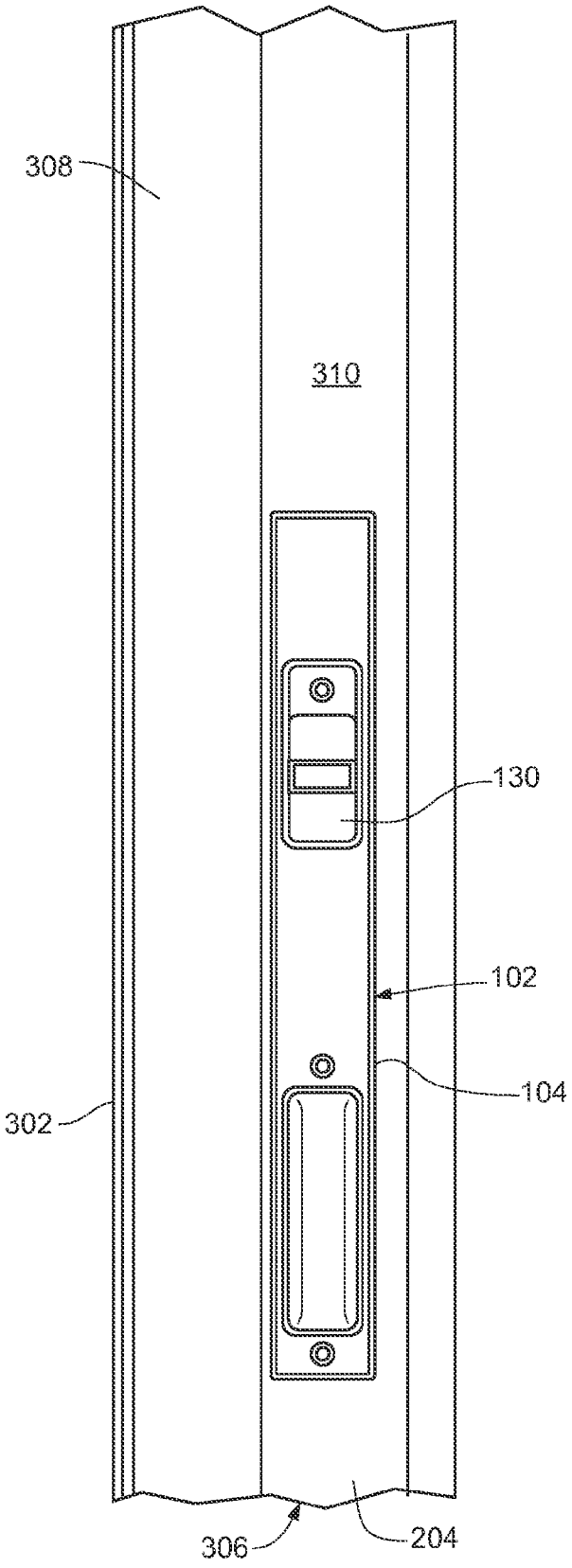
FIG. 2A is a side elevation view of an interior lock actuator assembly, with the lock control in an unlocked position, installed in a door according to an embodiment of the invention, and with the side stile of the door abutted with the frame of the door.
Figure 2B:
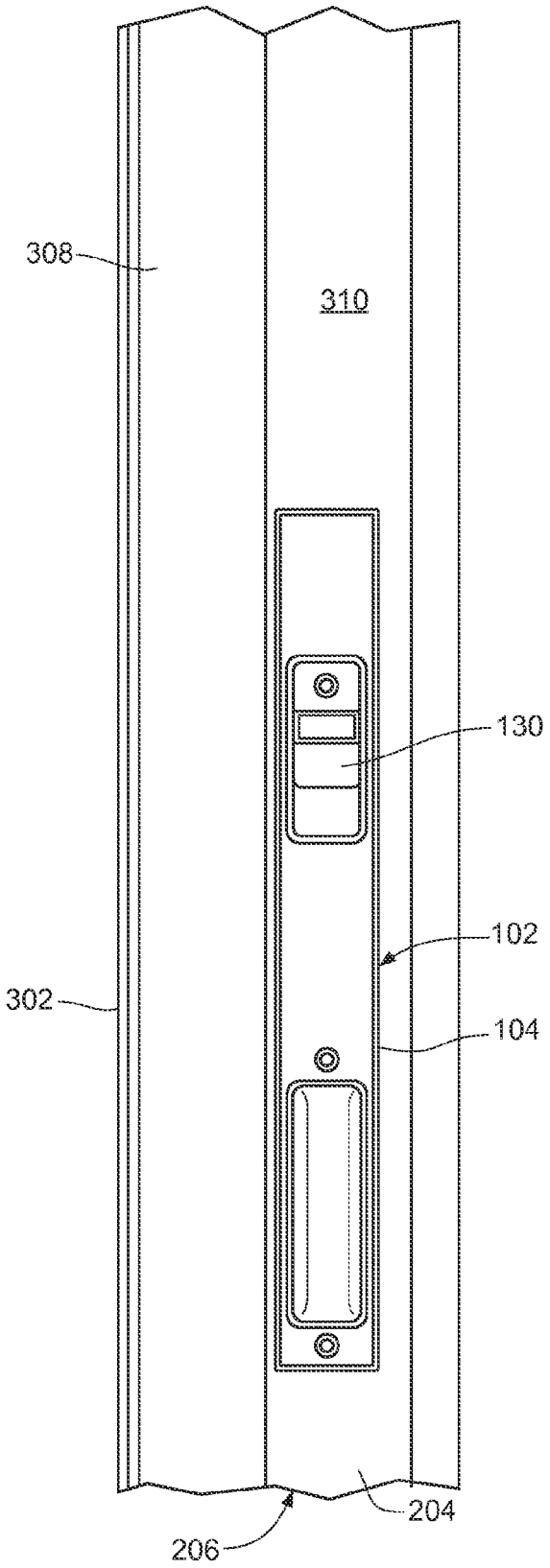
FIG. 2B is a side elevation view of the interior lock actuator assembly of FIG. 2A in a locked position.

Interior lock actuator assembly 102 is configured to be received into a recess (not depicted) in inwardly facing surface 204 of side stile 310 of sliding door panel 306, as depicted in FIGS. 2A and 2B. Interior lock actuator assembly 102 may be mounted flush with inwardly facing surface 204 of side stile 310, or may be mounted so as to slightly protrude from inwardly facing surface 204, as depicted in FIG. 4B.

Figure 3:
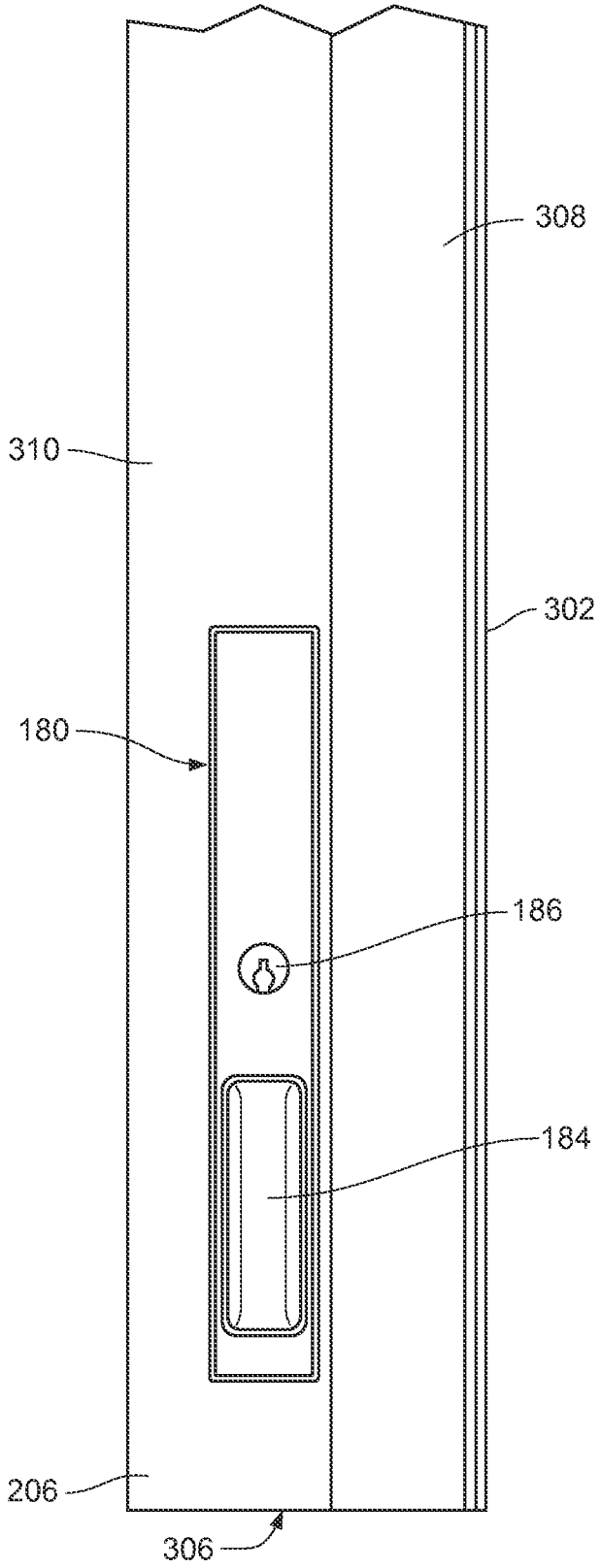
FIG. 3 is a side elevation view of an exterior lock actuator assembly installed in a door according to an embodiment of the invention.

Exterior lock actuator assembly 180 is configured to be received into a recess (not depicted) in outwardly facing surface 206 of side stile 310 of sliding door panel 306, as depicted in FIG. 3. Exterior lock actuator assembly 180 may be mounted flush with outwardly facing surface 206 of side stile 310, or may be mounted so as to slightly protrude from outwardly facing surface 206 of side stile 310 as depicted in FIG. 4B.

Figure 4A:
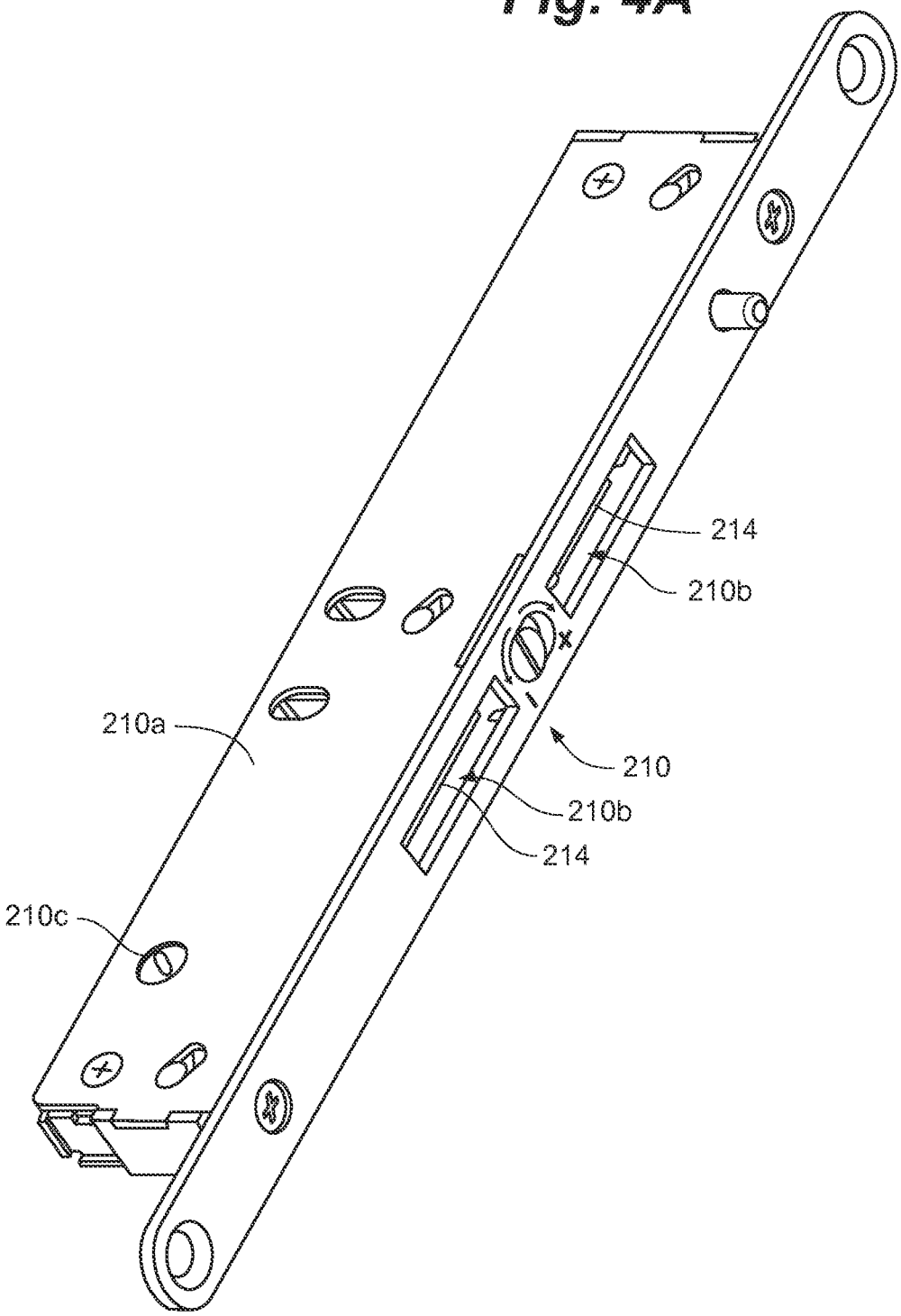
FIG. 4A is an orthogonal view of a lock assembly according to an embodiment of the present invention.
Figure 4B:
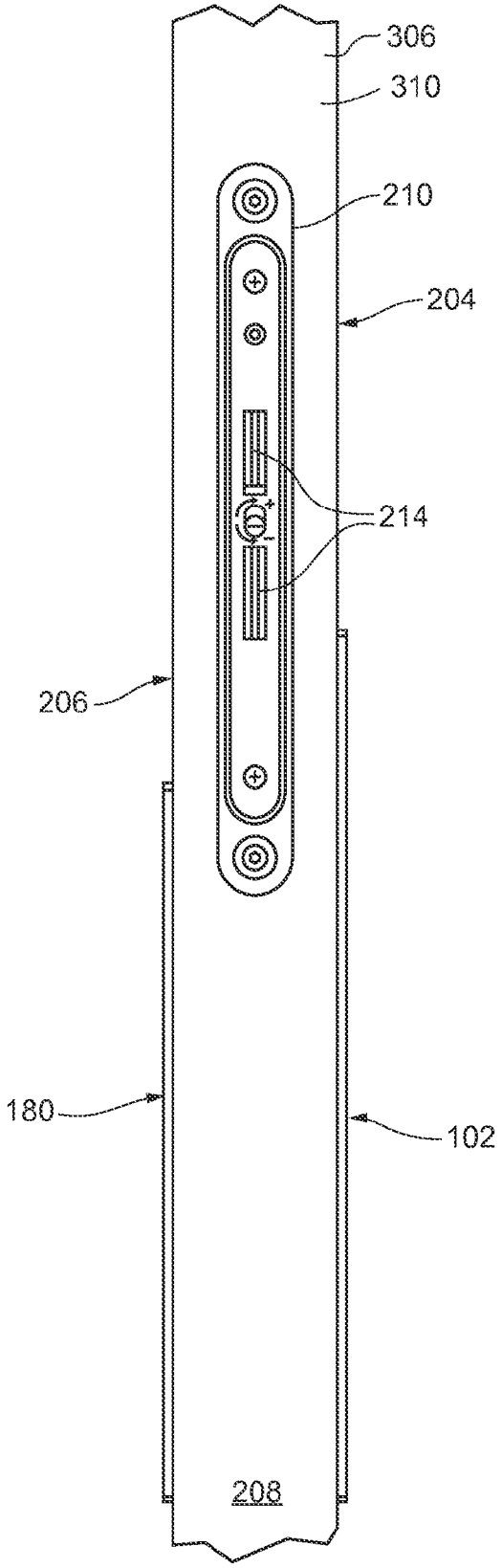
FIG. 4B is an end elevation view of a lock actuating assembly installed in a door according to an embodiment of the invention.
Figure 5A:
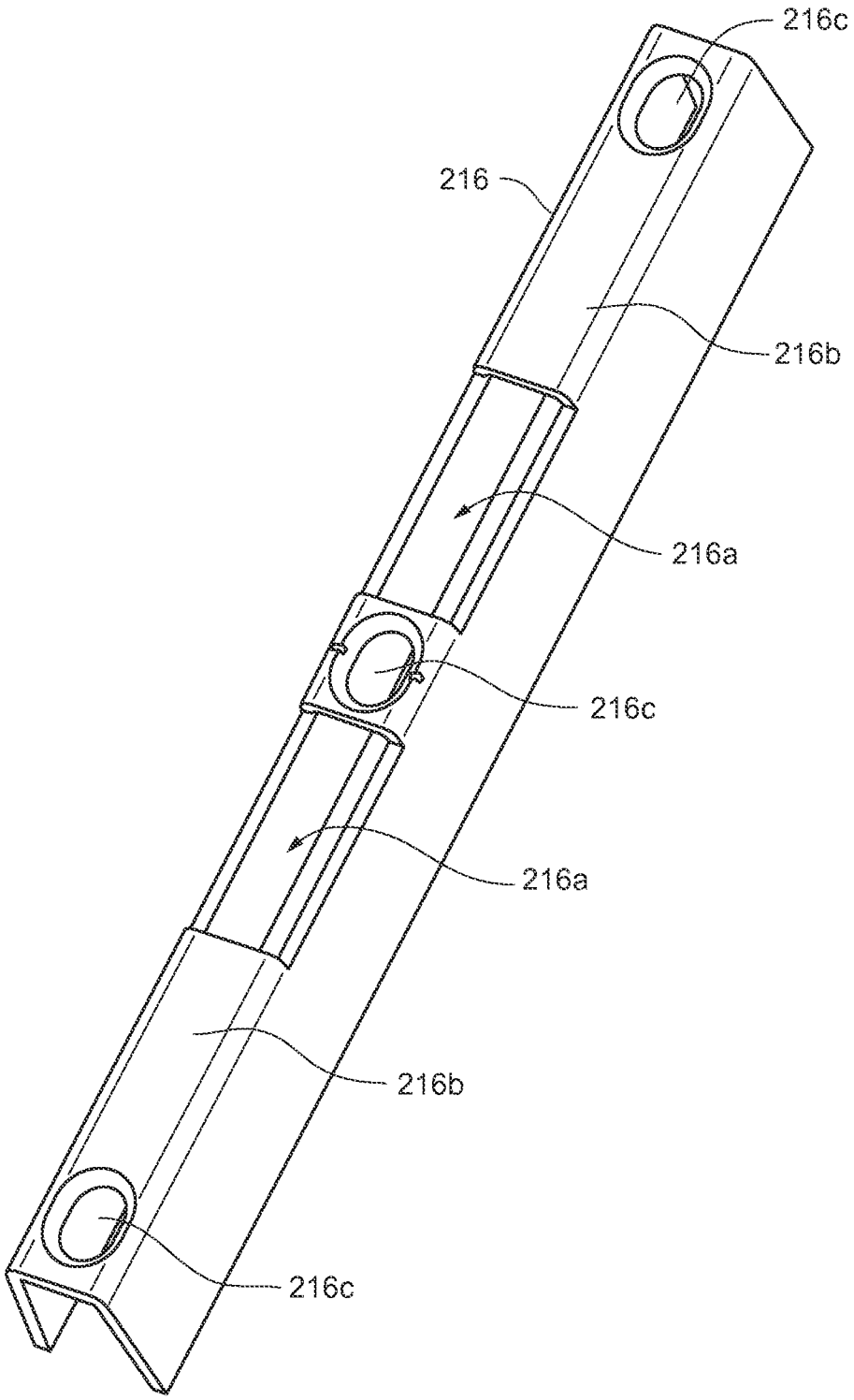
FIG. 5A is an orthogonal view of a lock keeper according to an embodiment of the invention.
Figure 5B:
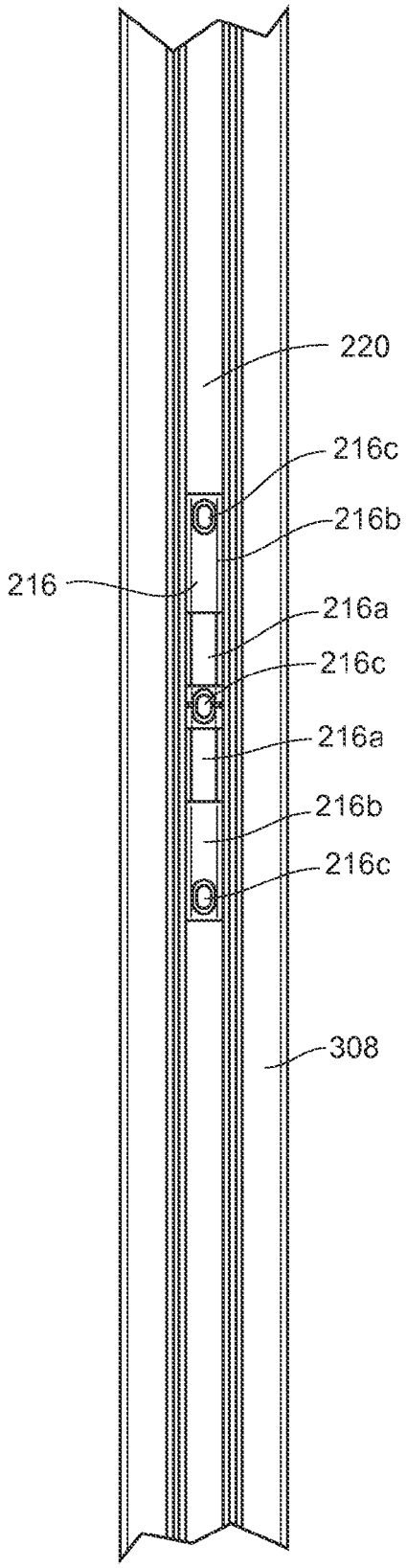
FIG. 5B is an end elevation view of the lock keeper of FIG. 5A installed in a side frame jamb.
Figure 6:
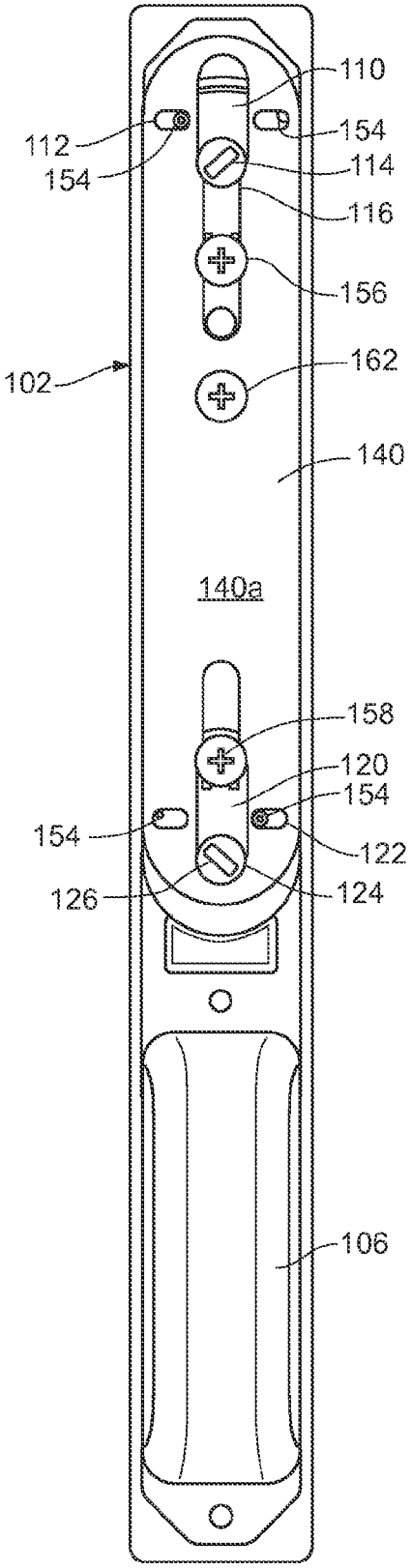
FIG. 6 is an elevation view of the backside of an assembled interior lock actuating assembly according to an embodiment of the invention.

Referring now to FIGS. 4A-5B, lock assembly 210 may be a single-point or multi-point lock, and may be a mortise lock assembly as depicted in FIGS. 4A-4B. In such case, lock assembly 210 is received in a mortise (not depicted) in outer surface 208 of side stile 310 of sliding door panel 306. Lock assembly 210 has a pair of hooks 214, which are selectively extendable and retractable from housing 210*a* though openings 210*b* by rotation of actuating control 210*c*. Keeper 216 is received in a recess (not depicted) in inwardly facing wall 220 of jamb 308, and is secured to jamb 308 with fasteners (not depicted) through apertures 216*c*. When extended, hooks 214 engage central wall 216*b* of keeper 216 through openings 216*a*, so as to couple lock assembly 210 and door panel 306 to keeper 216 and jamb 308, respectively. Further details of various lock assemblies 210 as may be suitable for use in the present invention may be found in U.S. Pat. No. 8,899,635, said patent being owned by the owners of the present application, and hereby fully incorporated herein in its entirety by reference.

Figure 7:
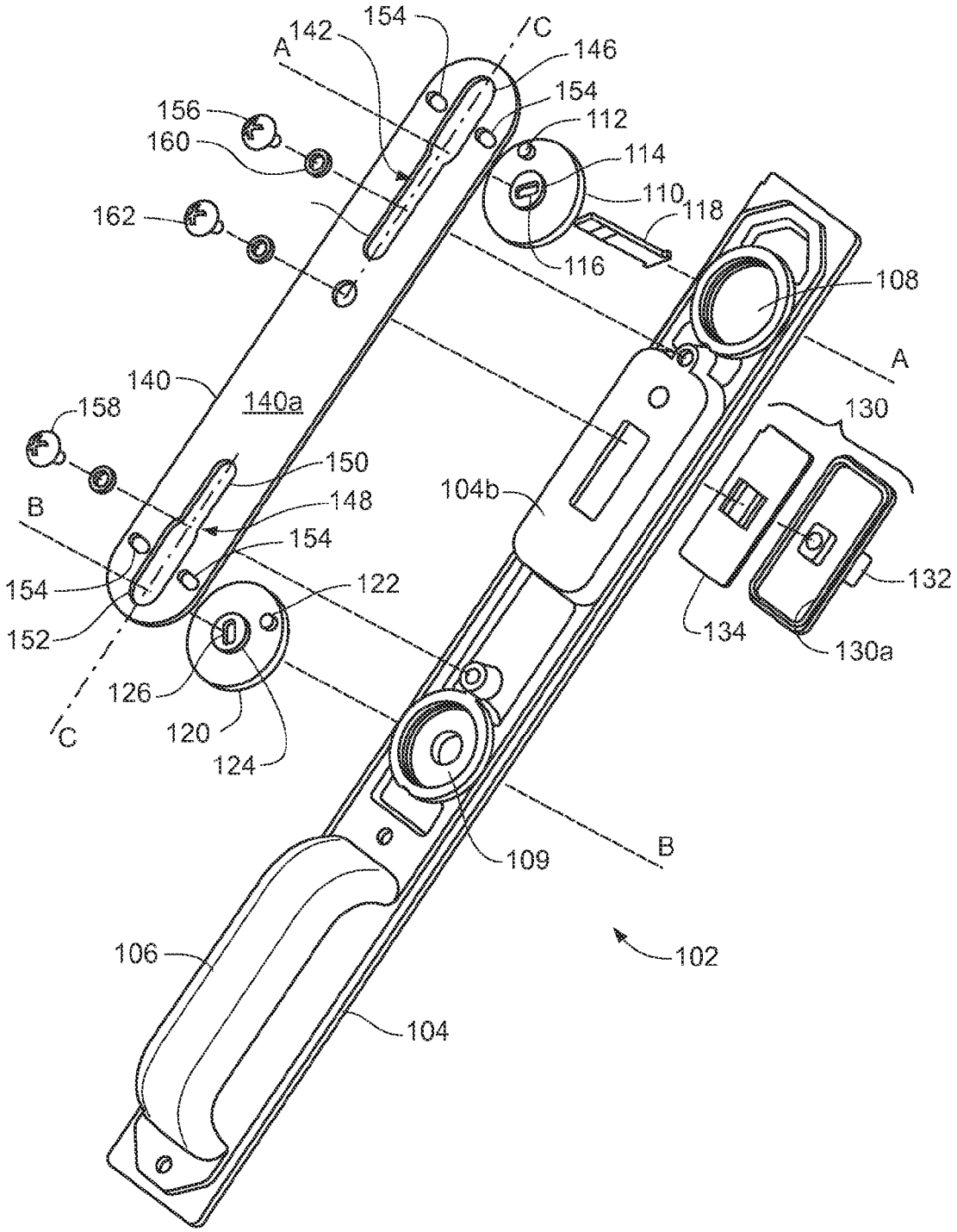
FIG. 7 is an orthogonal exploded view of the interior lock actuating assembly of FIG. 6.
Figure 8:
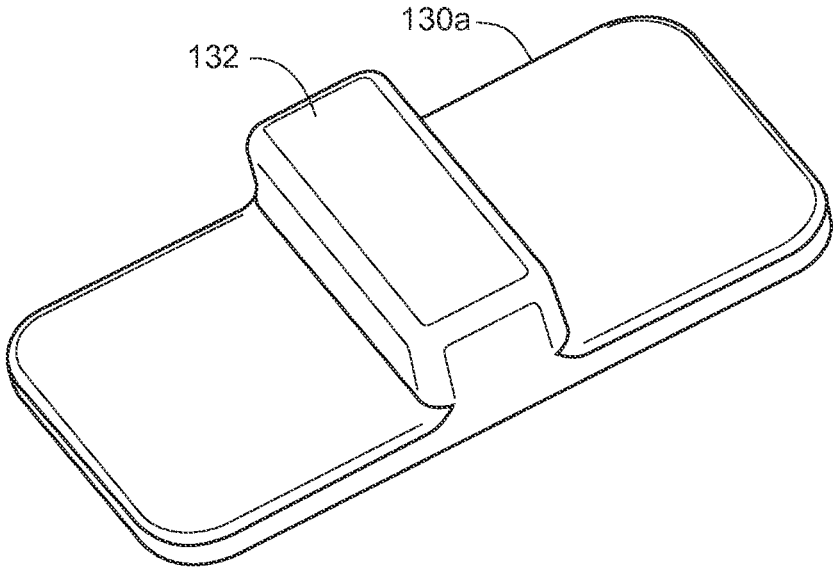
FIG. 8 is an orthogonal view of a thumb slide of an interior lock actuating assembly according to an embodiment of the invention.
Figure 9:
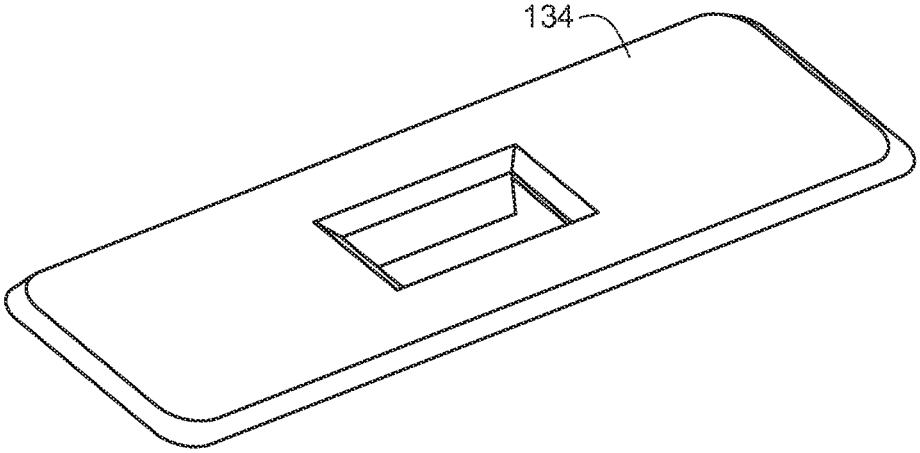
FIG. 9 is an orthogonal view of a thumb slide sleeve of an interior lock actuating assembly according to an embodiment of the invention.
Figure 10:
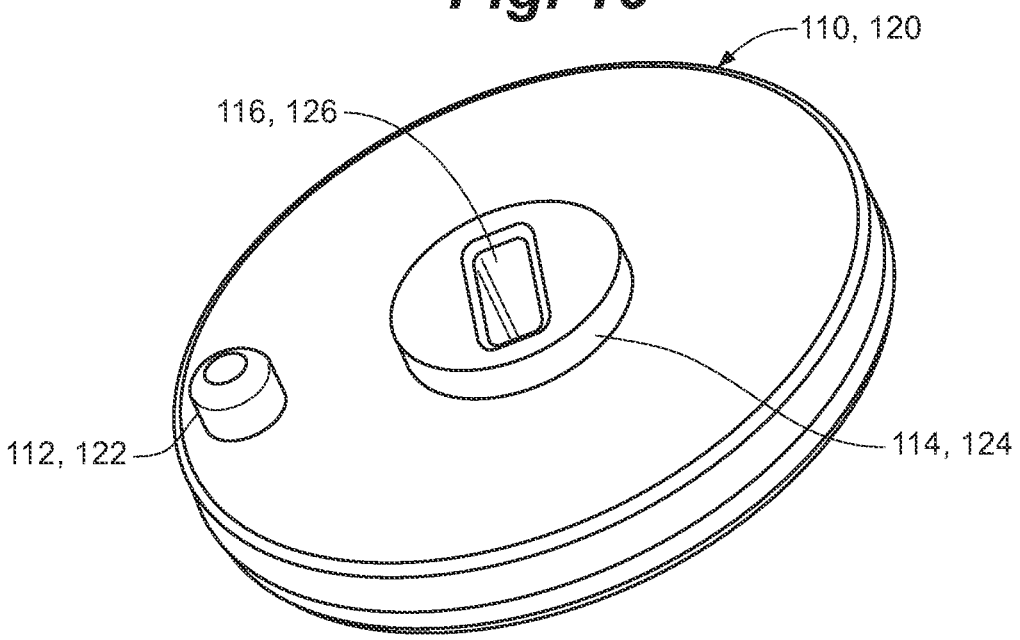
FIG. 10 is an orthogonal view of a drive disk according to an embodiment of the invention.
Figure 11:
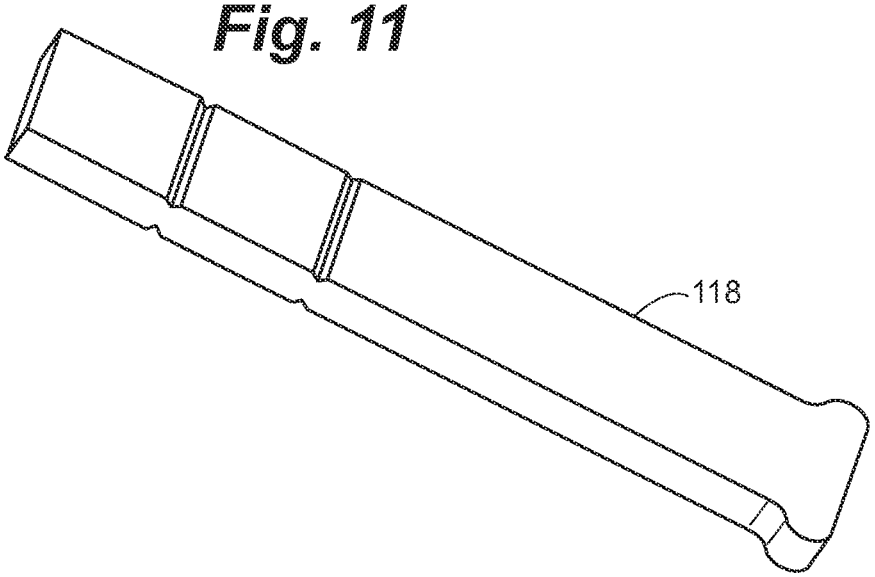
FIG. 11 is an orthogonal view of a drive tung according to an embodiment of the invention.

Referring now to FIGS. 2A, 2B and 6-14, various embodiments of interior lock actuator assembly 102 will be described. Interior lock actuator assembly 102 generally includes interior escutcheon 104 defining handle or grip feature 106 which may be a separate component coupleable to escutcheon 104, or integrated with or otherwise integrally formed as a part of escutcheon 104 as depicted in FIG. 7. Handle or grip feature 106 generally defines recess 107. Escutcheon 104 is configured to receive or otherwise couple with lock actuator assembly components including lock actuator drive disk 110, key drive disk 120, a control in the form of thumb slide 130, and slide arm 140.

Lock actuator drive disk 110 generally includes drive protrusion 112 which is offset from axis of rotation A-A of lock actuator drive disk 110, and center locating hub protrusion 114 through which aperture 116 is provided. A lock actuator drive tail or tung 118 extends through aperture 116 of lock actuator drive disk 110. Alternatively, lock actuator drive tail or tung 118 may be integrally formed as part of lock actuator drive disk 110 during manufacture. Lock actuator drive disk 110 is received in disk carrier recess 108 defined in escutcheon 104 such that lock actuator drive disk 110 is freely rotatable about axis of rotation A-A while being restrained from lateral movement or translation by disk carrier recess 108.

Key drive disk 120 generally includes drive protrusion 122 which is offset from an axis of rotation B-B of key drive disk 120, and center locating hub protrusion 124 through which aperture 126 is provided for receiving a drive tail from a key cylinder, as described below. Key drive disk 120 is received in disk carrier recess 109 on escutcheon 104, such that key drive disk 120 is freely rotatable about axis of rotation B-B, while being restrained from lateral movement or translation by disk carrier recess 109.

Thumb slide assembly 130 provides an interior control for operating lock actuating assembly 100, and includes body 130*a* with protrusion 132, or other similar feature suitable for manipulating by a user. Thumb slide assembly 130 is received within a corresponding recess 104*a* defined by enclosure 104*b* of escutcheon 104. Sleeve 134 is optionally included which functions as a washer and/or spacer, reducing friction during sliding operation of body 130*a* within recess 104*a*. It will be appreciated that recess 104*a* may be of varying depth, and protrusion 132 may be of varying height, such that protrusion 132 is below, flush with, or extending above rim 104*c* of recess 104*a*.

Slide arm 140 generally includes elongate plate 140*a* extending between, and coupled with, lock actuator drive disk 110 and key drive disk 120 to provide a link between a user input of a rotational movement of key drive disk 120 or a translational movement of thumb slide assembly 130 and a resulting rotational output movement of lock actuator drive disk 110. Slide arm 140 may include a first channel 142 having a first portion 144 and a second portion 146, and a second channel 148 having a first portion 150 and a second portion 152. A plurality of pivot apertures 154 are provided proximate each end of arm 140, the apertures 154 configured to receive drive protrusions 112, 122 of disks 110, 120, respectively. Apertures 154 may be formed in a slot or oval shape as depicted, or another configuration, such as a lost-motion mechanism, that links a rotational movement of disks 110, 120, and a translational movement of slide arm 140, and vice versa. Slide arm 140 translates a user input in the form of movement of thumb slide assembly 130 or key cylinder 186 into an output action—movement of lock assembly 210 so as to lock or unlock assembly 210. As depicted generally in the figures, slide arm 140 is configured to translate vertically along axis C-C.

Slide arm 140 is secured to escutcheon 104 with first retainer 156 and second retainer 158, such that retainer 156 is received in first portion 144 of first channel 142 and retainer 158 is received in first portion 150 of second channel 148. One or more spacers 160 may be provided between slide arm 140 and escutcheon 104. Each of retainers 156, 158 secure slide arm 140 to escutcheon 104 and also act as guide pins to direct, constrain and/or restrict movement of slide arm 140 by interaction with first portions 144 and 150 of first channel 142 and second channel 148, respectively, during sliding translation of slide arm 140. Similarly, slide arm 140 is guided and/or constrained by interaction between second portion 146 and locating protrusion 124 of key drive disk 120, and by second portion 152 and locating protrusion 114 of lock actuator drive disk 110. One or more spacers 160 may be included in conjunction with retainers 156, 158. Fastener 162 secures thumb slide assembly 130 to slide arm 140. In alternate arrangements (not depicted), it will be appreciated that slide arm 140 could be replaced by a linkage or other mechanism which couples lock actuator drive disk 110 and key drive disk 120.

Figure 12A:
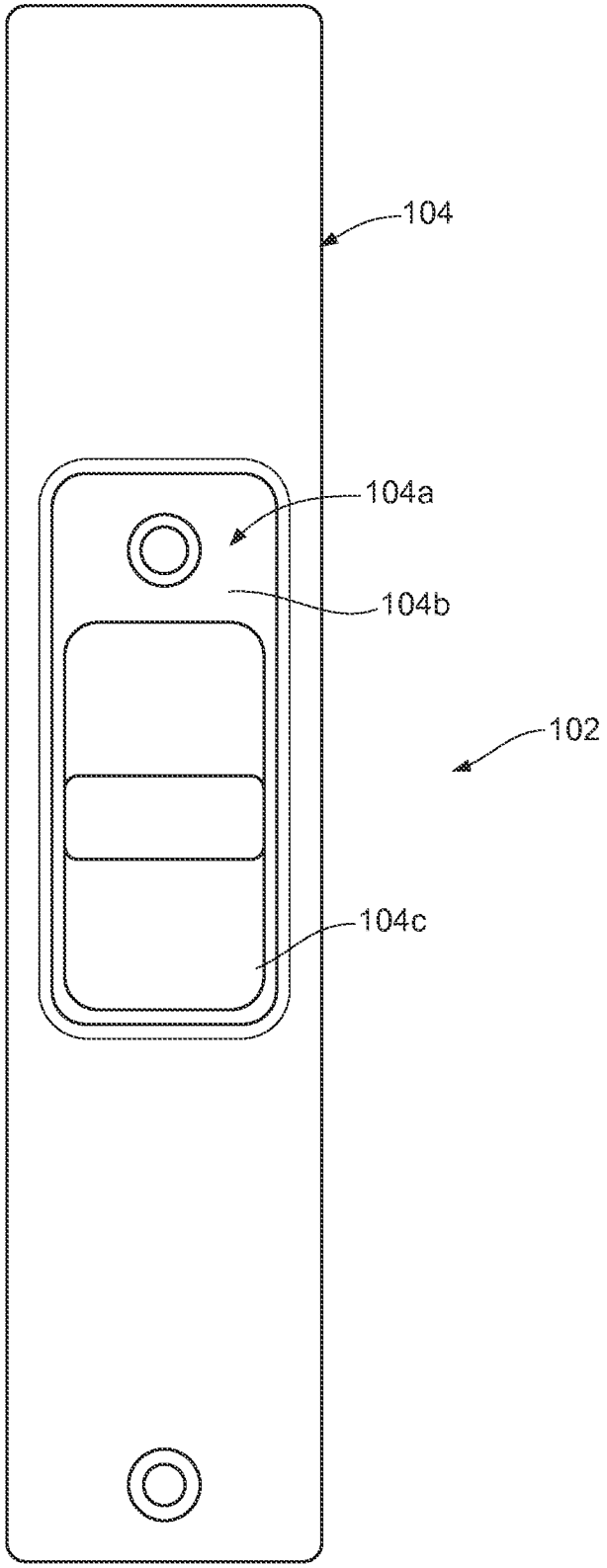
FIG. 12A is a side elevation view of an interior lock actuator assembly in an unlocked position according to another embodiment of the invention.
Figure 12B:
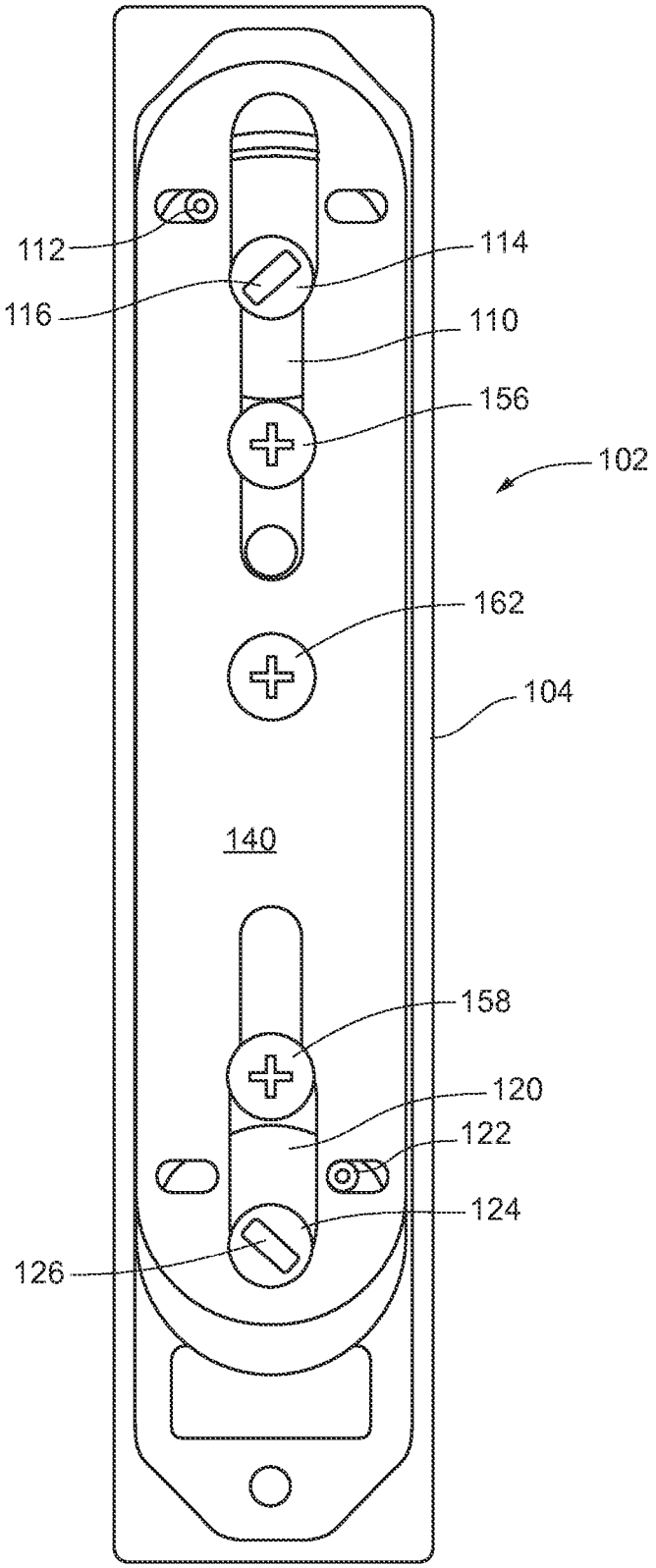
FIG. 12B is an elevation view of the backside of the assembled interior lock actuating assembly of FIG. 12A.

As depicted in FIGS. 12A-12B, escutcheon 104 of interior lock actuator assembly 102 may be formed without any integrated handle or grip element in some embodiments.

Figure 13:
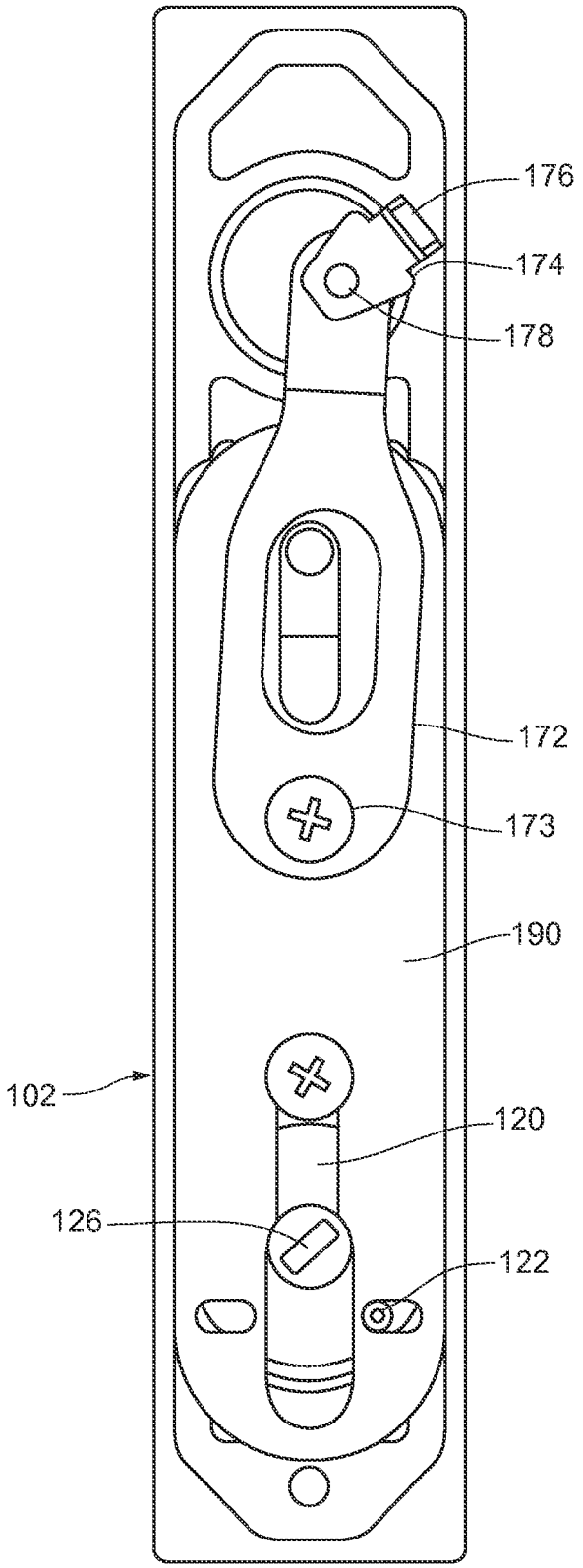
FIG. 13 is an elevation view of the backside of an assembled interior lock actuating assembly according to another embodiment of the invention.
Figure 14:
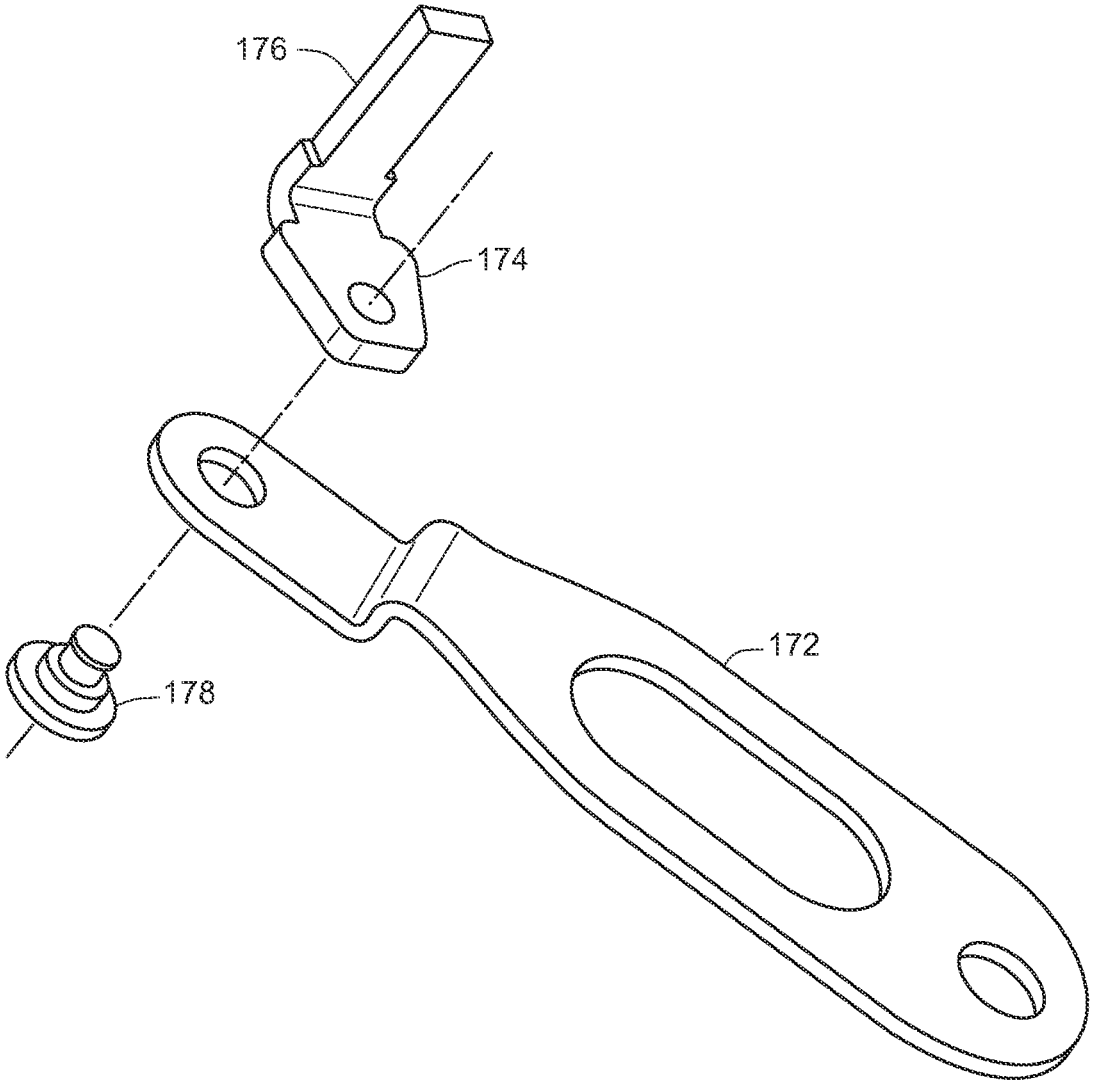
FIG. 14 is an exploded orthogonal view of an interior lock actuator according to the embodiment of FIG. 13.

Another embodiment of an interior lock actuator assembly 102 is depicted in FIGS. 13-14. Interior lock actuator assembly 102 generally includes a pivotable arm 172 secured to slide arm 140 with fastener 173, an offset lock actuator 174 having a drive tab portion 176, the offset lock actuator 174 coupled to arm 172 via pivot pin 178. Arm 172 is used in place of lock actuator drive disk 110 relative to the embodiment of FIGS. 1-12B, but other components of lock actuating assembly 102 remain unchanged.

Figure 15:
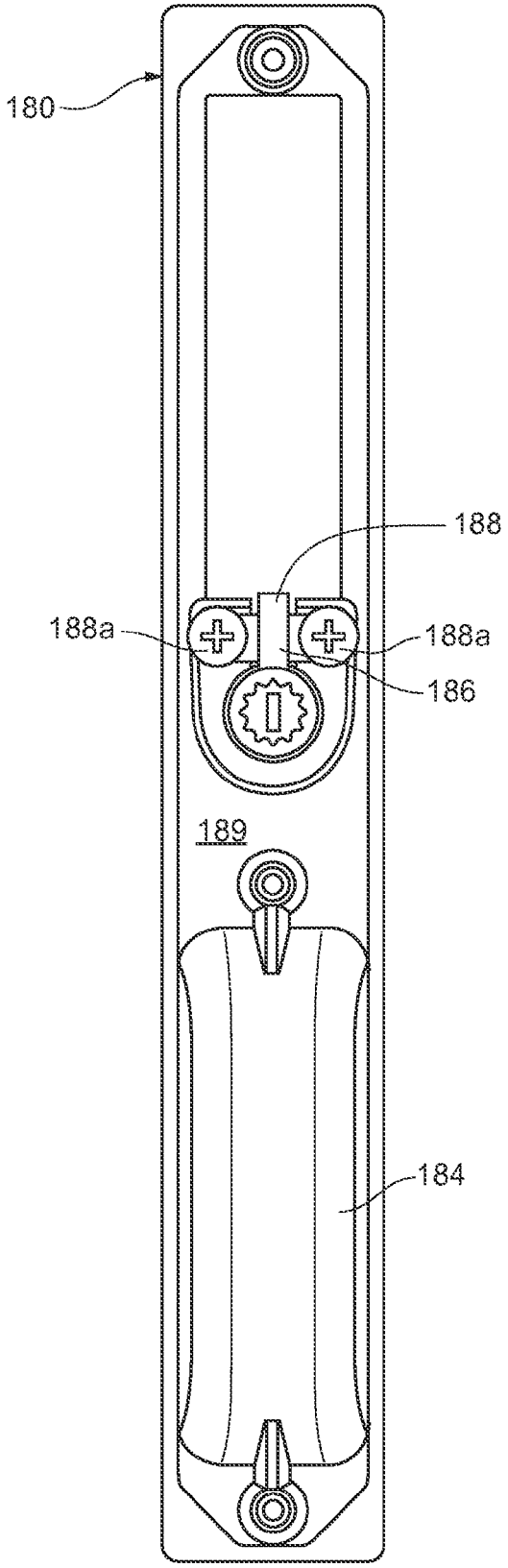
FIG. 15 is an elevation view of the backside of an assembled exterior lock actuating assembly according to an embodiment of the invention.
Figure 16:
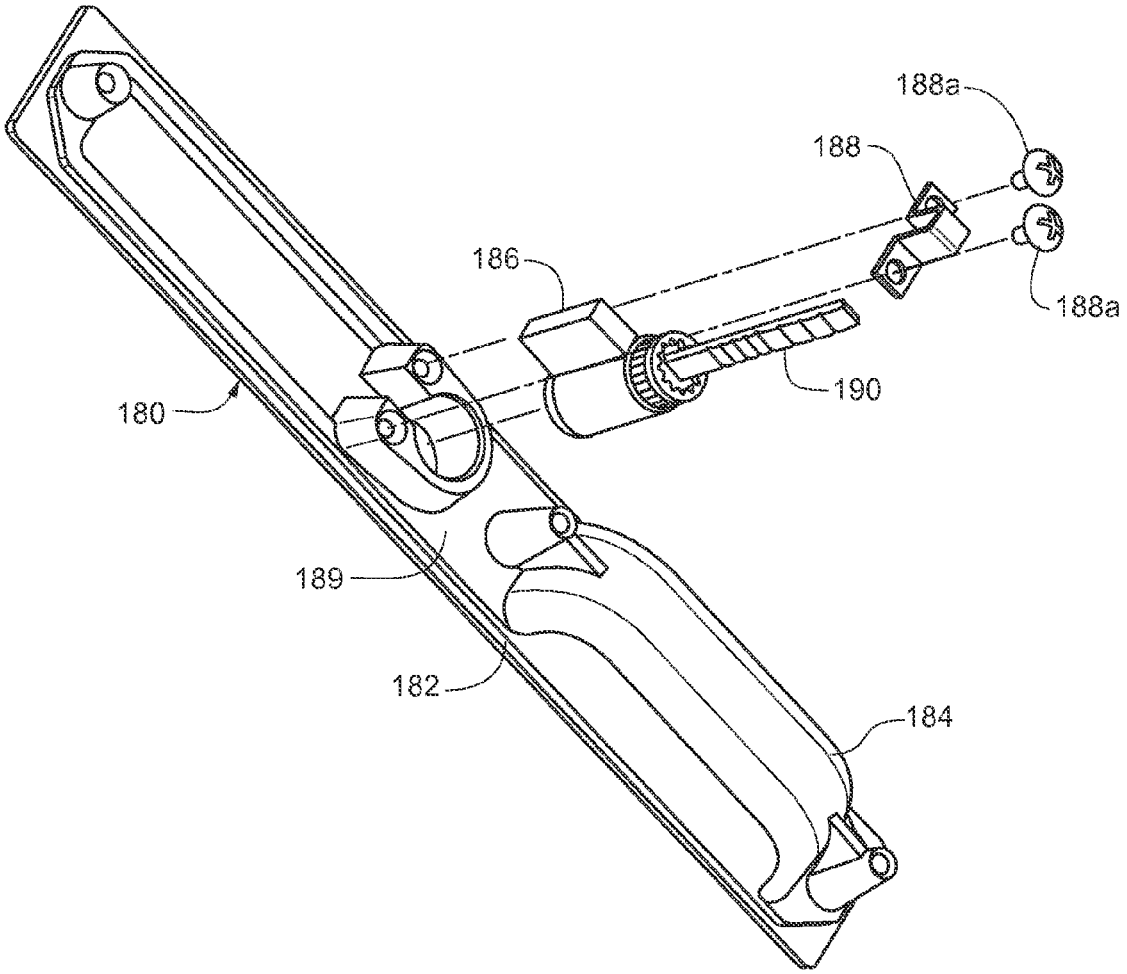
FIG. 16 is an orthogonal exploded view of the interior lock actuating assembly of FIG. 15.

Referring now to FIGS. 15-16, exterior lock actuator assembly 180 generally includes exterior escutcheon 182 having a recessed handle or grip feature 184 which may be a separate component coupleable to escutcheon 182, or integrated with or otherwise formed as a part of escutcheon 182. Exterior lock actuator assembly 180 further includes key cylinder 186 (optional), secured to back side 189 with a strap 188 and one or more fasteners 188*a*. A key cylinder drive tail 190 is received in center aperture 126 of key drive disk 120.

Figure 17A:
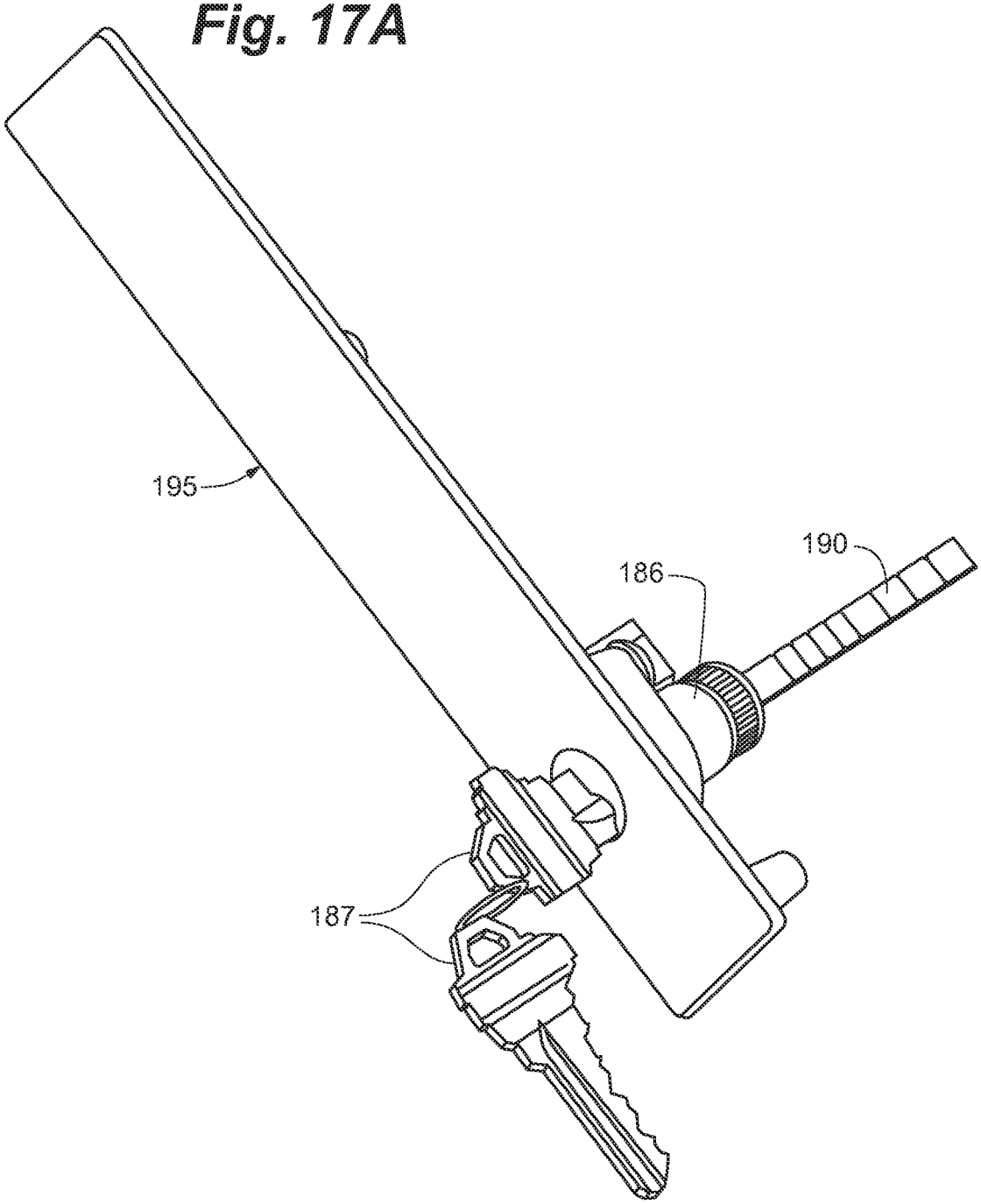
FIG. 17A is an orthogonal view of an exterior lock actuator assembly according to another embodiment of the invention.
Figure 17B:
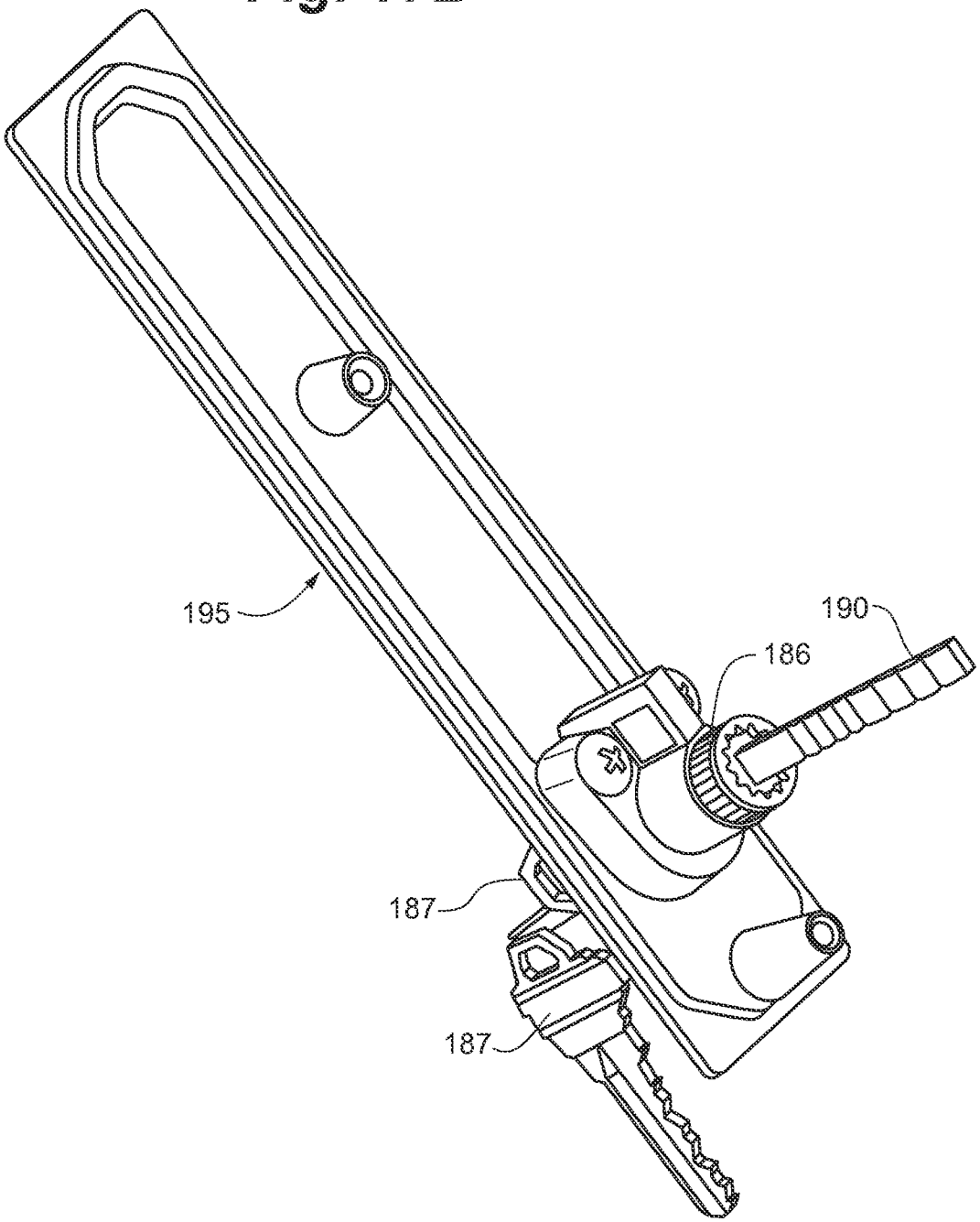
FIG. 17B is an alternate orthogonal view of the exterior lock actuator assembly of FIG. 17A.

Another embodiment of an exterior lock actuator assembly is depicted in FIGS. 17A-B. Exterior lock actuator assembly 195 is similar to the exterior lock actuator assembly 180 depicted in FIGS. 15 and 16, but lacks an integrated handle or grip element. In all other aspects, exterior lock actuator assembly 195 is identical to exterior lock actuator assembly 180.

Figure 18A:
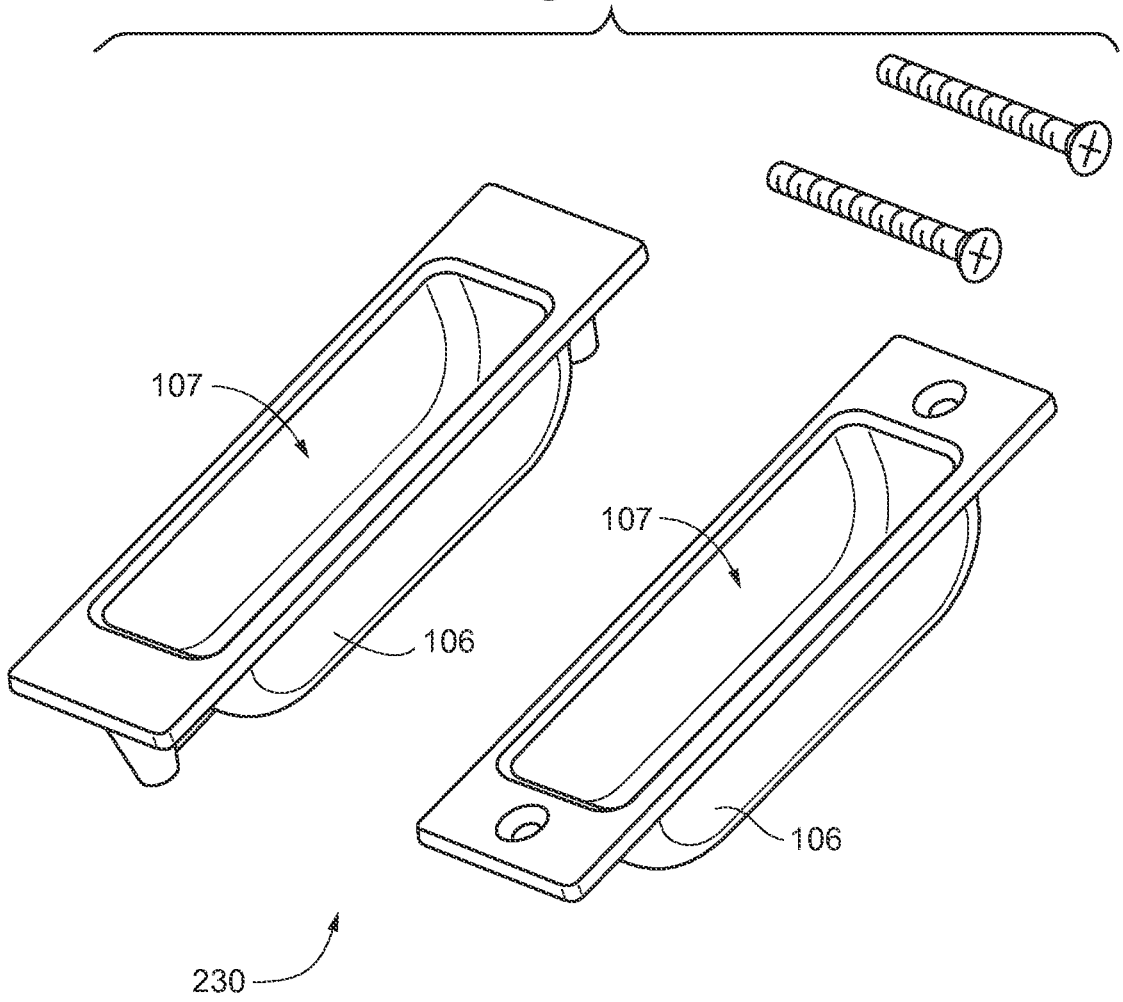
FIG. 18A is an orthogonal view of shallow profile handles according to an embodiment of the invention.
Figure 18B:
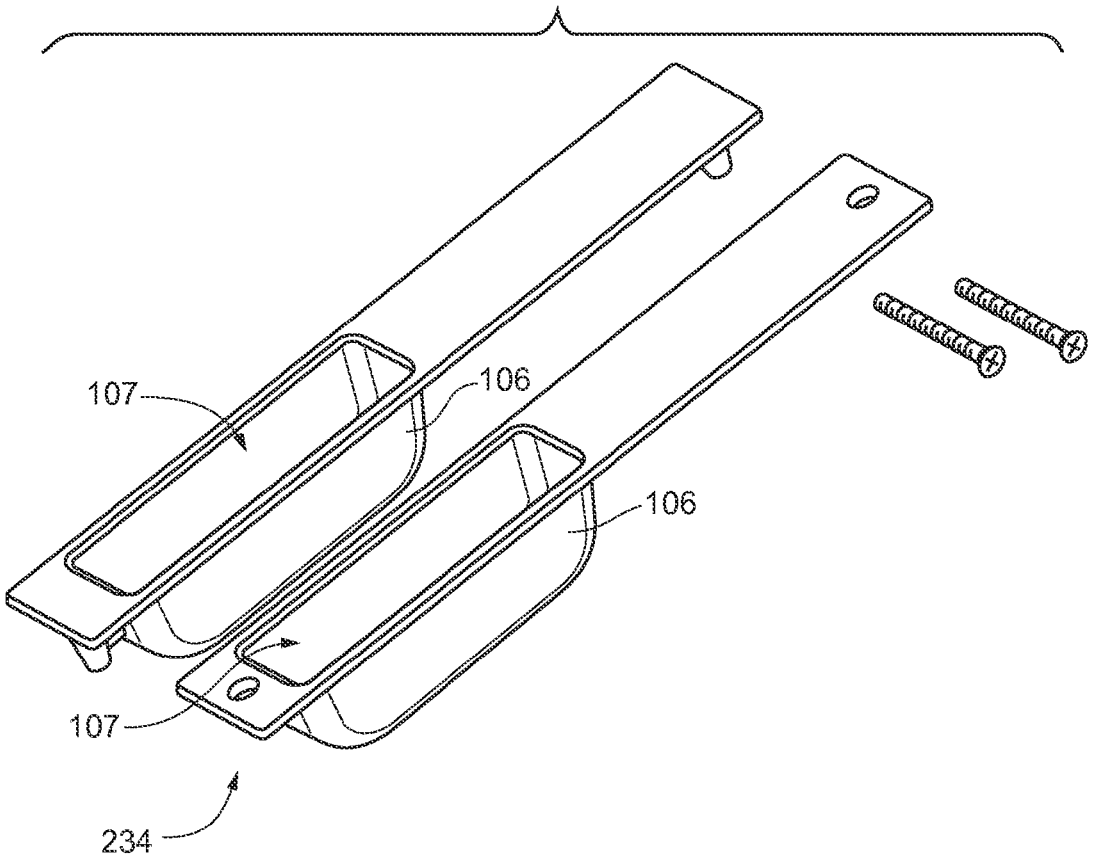
FIG. 18B is an orthogonal view of deep profile handles according to an embodiment of the invention.

Referring now to FIGS. 18A-B, standalone handle portions 230, 234, are depicted, which can be used in conjunction with the handle-less lock actuator embodiments of FIGS. 12A-B or FIGS. 17A-B. The handle portions 230 of FIG. 18A feature a shallow handle recess 107, while the handles 234 of FIG. 18B feature a deeper handle recess 107.

In use, lock actuating assembly 100 can be operated from an interior side or an exterior side. To unlock from the interior side, a user moves thumb slide assembly 130 from the locked position depicted in FIG. 2B downward to the unlocked position depicted in FIG. 2A. As thumb slide assembly 130 is directly coupled to slide arm 140, such translational movement of thumb slide assembly 130 causes a corresponding downward translation of slide arm 140. The motion of slide arm 140 is constrained by channels 142 and 148 interacting with retaining members 156, 158 and center hub protrusions 114, 124. As slide arm 140 is moved by thumb slide assembly 130, lock actuator drive disk 110 is rotated by way of drive protrusion 112 of lock actuator drive disk 110 being received in corresponding aperture 154 of slide arm 140. As lock actuator drive disk 110 rotates, drive tail 118 operates lock assembly 210 by way of lock drive recess 212, as depicted in FIGS. 1B and 1D, so as to retract hooks 214 and thereby unlock lock assembly 210. The operation is reversed in order to lock the lock assembly 210, with a user moving thumb slide 130 from the unlocked position depicted in FIG. 2A upward to the locked position depicted in FIG. 2B, thereby extending hooks 214.

To operate the lock assembly 210 from the exterior side, a user turns key 187 in key cylinder 186, which causes key drive disk 120 to rotate via key drive tail 190. As key drive disk 120 rotates, slide arm 140 is translated by way of the communication between drive protrusion 122 of key drive disk 120 and corresponding aperture 154 defined in slide arm 140, which causes a corresponding rotation of lock actuator drive disk 110 by way of the communication between drive protrusion 112 of lock actuator drive disk 110 and the corresponding aperture 154 defined in slide arm 140. As lock actuator drive disk 110 rotates, drive tail 118 operates lock assembly 210 by way of lock drive recess 212, as best depicted in FIGS. 1B and 1D. Rotating key 187 in a first direction locks the assembly 210, while rotating key 187 in the opposite direction unlocks the assembly 210.

In the embodiments depicted herein, the non-limiting materials of construction for lock actuating assembly 100 include plastic, composite (e.g., fiberglass, plastic-impregnated wood), metal or other materials or combinations thereof known to the artisan. The lock actuating assembly 100 is suitable for use with doors constructed from vinyl plastic, aluminum, wood, composite, or other door materials.

References to relative terms such as upper and lower, front and back, left and right, or the like, are intended for convenience of description and are not contemplated to limit the invention, or its components, to any specific orientation. All dimensions depicted in the figures may vary with a potential design and the intended use of a specific embodiment of this invention without departing from the scope thereof.

Each of the additional figures and methods disclosed herein may be used separately, or in conjunction with other features and methods, to provide improved devices, systems and methods for making and using the same. Therefore, combinations of features and methods disclosed herein may not be necessary to practice the invention in its broadest sense and are instead disclosed merely to particularly describe representative embodiments of the invention.

The invention claimed is:

1. A lock assembly comprising:

an interior lock actuator assembly, including:

an interior escutcheon presenting a substantially planar outer surface and including a first handle portion recessed relative to the outer surface, and a first control;

a first rotatable drive disk;

a second rotatable drive disk; and slide arm operably coupled with the first drive disk, the second drive disk, and the first control;

an exterior lock actuator assembly comprising an exterior escutcheon presenting a substantially planar outer surface and including a second handle portion recessed relative to the outer surface and a second control, the second control operably coupled with the second drive disk; and a lock mechanism comprising a housing and at least one lock element, the at least one lock element selectively shiftable between an unlocked position in which the at least one lock element is contained in the housing and a locked position in which the at least one lock element extends from the housing, wherein the first drive disk is operably connected with the at least one lock element so as to drive shifting of the at least one lock element between the unlocked position and the locked position when the first drive disk is rotated, and wherein the first control and the second control are selectively operable to rotate the first drive disk.

2. The lock assembly of claim 1, wherein the first control is a thumb slide.

3. The lock assembly of claim 2, wherein the thumb slide is coupled to the slide arm so as to vertically shift the slide arm, and the slide arm is coupled to the first drive disk such that vertical shifting of the slide arm rotates the first drive disk.

4. The lock assembly of claim 1, wherein the second control is a key cylinder.

5. The lock assembly of claim 4, wherein the key cylinder is operably coupled to the second drive disk.

6. The lock assembly of claim 1, wherein the at least one lock element is a hook.

7. A sliding door assembly, comprising;

a door panel slidably mounted in a frame, the frame including a jamb; and a lock assembly in the door panel, the lock assembly comprising:

an interior lock actuator assembly, including:

an interior escutcheon presenting a substantially planar outer surface and including a first handle portion recessed relative to the outer surface, and a first control, an outer surface of the interior escutcheon being substantially flush with an inwardly facing surface of the door panel;

a first rotatable drive disk;

a second rotatable drive disk; and a slide arm operably coupled with the first drive disk, the second drive disk, the first control;

an exterior lock actuator assembly comprising an exterior escutcheon presenting a substantially planar outer surface and including a second handle portion recessed relative to the outer surface and a second control, an outer surface of the exterior escutcheon being substantially flush with an outwardly facing surface of the door panel, the second control operably coupled with the second drive disk; and a lock mechanism comprising a housing and at least one lock element, the at least one lock element selectively shiftable between an unlocked position in which the at least one lock element is contained in the housing and a locked position in which the at least one lock element extends from the housing to engage a keeper in the jamb, wherein the first drive disk is operably connected with the at least one lock element so as to drive shifting of the at least one lock element between the unlocked position and the locked position when the first drive disk is rotated, and wherein the first control and the second control are selectively operable to rotate the first drive disk.

8. The sliding, door assembly of claim 7, wherein the first control is a thumb slide.

9. The sliding door assembly of claim 8, wherein the thumb slide is coupled to the slide arm so as to vertically shift the slide arm, and the slide arm is coupled to the first drive disk such that vertical shifting of the slide arm rotates the first drive disk.

10. The sliding door assembly of claim 7, wherein the second control is a key cylinder.

11. The sliding door assembly of claim 10, wherein the key cylinder is operably coupled to the second drive disk.

12. The sliding door assembly of claim 7, wherein the at least one lock element is a hook.

13. A lock actuator assembly comprising:

an interior lock actuator assembly, including:

an interior escutcheon presenting a substantially planar outer surface and including a first handle portion recessed relative to the outer surface and a control;

at least one rotatable drive disk; and a vertically slidable arm operably couple with the at least one drive disk so as to rotate the at least one drive disk when the arm is shifted vertically with the control;

an exterior lock actuator assembly comprising an exterior escutcheon presenting a substantially planar outer surface and including a second handle portion recessed relative to the outer surface; and wherein the at least one rotatable drive disk is adapted to couple with a lock assembly so as to shift the lock assembly between a locked position and an unlocked position when the at least one rotatable drive disk rotates, the lock actuator assembly further comprising second rotatable drive disk operably coupled to the arm such that rotation of the second drive disk vertically shifts the arm.

14. The lock actuator assembly of claim 13, wherein the control is a thumb slide.

15. The lock actuator assembly of claim 13, wherein the exterior lock actuator assembly comprises a second control rotatably coupled to the second drive disk.

16. The lock actuator assembly of claim 15, wherein the second control is a key cylinder.

* * * * *